US007604094B2

(12) United States Patent
Magyari

(10) Patent No.: US 7,604,094 B2
(45) Date of Patent: Oct. 20, 2009

(54) ACOUSTIC SCATTERER

(76) Inventor: Douglas P. Magyari, 4206 Arlington, Royal Oak, MI (US) 48073

( * ) Notice: Subject to any disclaimer, the term of this patent is extended or adjusted under 35 U.S.C. 154(b) by 0 days.

(21) Appl. No.: 11/910,260

(22) PCT Filed: Apr. 14, 2006

(86) PCT No.: PCT/JP2006/013992

§ 371 (c)(1),
(2), (4) Date: Sep. 29, 2007

(87) PCT Pub. No.: WO2006/113399

PCT Pub. Date: Oct. 26, 2006

(65) Prior Publication Data

US 2008/0164094 A1 Jul. 10, 2008
US 2008/0308349 A1 Dec. 18, 2008

Related U.S. Application Data

(60) Provisional application No. 60/671,402, filed on Apr. 14, 2005.

(51) Int. Cl.
*E04B 1/82* (2006.01)

(52) U.S. Cl. ..... 181/286; 181/293; 181/294

(58) Field of Classification Search ..... 181/30, 181/286, 293, 290, 294, 295, 296; 52/144, 52/145; 415/119
See application file for complete search history.

(56) References Cited

U.S. PATENT DOCUMENTS 1,913,249 A * 6/1933 Sersen ..... 52/145
2,295,483 A 9/1942 Knowles
2,556,884 A 6/1951 Muller
2,652,126 A 9/1953 Mazer
2,779,429 A 1/1957 Mazer
3,035,657 A * 5/1962 Lemon ..... 181/290
3,997,020 A 12/1976 Busnel et al.
4,393,631 A * 7/1983 Krent ..... 52/144
4,671,841 A 6/1987 Stephens
4,858,720 A 8/1989 Murase et al.
5,027,920 A 7/1991 D'Antonio et al.
5,099,948 A 3/1992 Melhart
5,168,129 A 12/1992 D'Antonio
5,226,267 A 7/1993 D'Antonio et al.
5,329,073 A 7/1994 Shono et al.
5,362,931 A 11/1994 Fries
5,401,921 A * 3/1995 D'Antonio et al. ..... 181/286
5,422,446 A 6/1995 Fries
5,665,943 A 9/1997 D'Antonio (Continued)

OTHER PUBLICATIONS

Schroeder, Manfred R., "Self-Similarity and Fractals in Science and Art", J. Audio Eng. Soc., vol. 37, No. 10, Oct. 1969, pp. 795-808.

(Continued)

*Primary Examiner*—Jeffrey Donels
*Assistant Examiner*—Forrest M Phillips
(74) *Attorney, Agent, or Firm*—Raggio & Dinnin, P.C.

(57) ABSTRACT

An acoustic scatterer element (10) incorporates a plurality of convex surfaces (38.1, 38.2) has a plurality of associated curvatures in a corresponding plurality of different directions. A plurality of acoustic scatterer elements of various sizes in a cooperative relationship with one another provide for diffusing acoustic waves in a room (14).

91 Claims, 15 Drawing Sheets

U.S. PATENT DOCUMENTS

| | | | | |
|---|---|---|---|---|
| 5,744,763 | A | 4/1998 | Iwasa et al. | |
| 5,787,656 | A | 8/1998 | D'Antonio | |
| 5,793,873 | A | 8/1998 | Magyari et al. | |
| 5,817,992 | A | 10/1998 | D'Antonio | |
| 5,969,301 | A * | 10/1999 | Cullum et al. | 181/286 |
| 6,068,080 | A | 5/2000 | LaCarrubba | |
| 6,112,852 | A | 9/2000 | D'Antonio | |
| 6,431,312 | B1 | 8/2002 | D'Antonio | |
| 6,435,301 | B1 | 8/2002 | LaCarrubba | |
| 6,720,069 | B1 | 4/2004 | Murakami et al. | |
| 6,772,859 | B2 * | 8/2004 | D'Antonio et al. | 181/293 |
| 7,261,182 | B2 * | 8/2007 | Zainea | 181/293 |
| 7,314,114 | B2 * | 1/2008 | Gardner et al. | 181/293 |
| 2003/0006092 | A1 | 1/2003 | D'Antonio et al. | |
| 2004/0154862 | A1 | 8/2004 | Carlson | |
| 2006/0042875 | A1 * | 3/2006 | Zainea | 181/293 |
| 2006/0157297 | A1 | 7/2006 | D'Antonio | |
| 2007/0267248 | A1 * | 11/2007 | Gudim | 181/293 |

OTHER PUBLICATIONS

Zhou, Yan, Zhou, Yuan and Shene, C.-K, "Simple Swept Surfaces", Michigan Technological University, Course CS3621, 1997, downloaded from http://www.cs.mtu.edu/~shene/COURSES/cs3621/LAB/surface/swept.html on Feb. 12, 2007, 5 pp.

Weisstein, Eric W., "Surface of Revolution." From MathWorld—A Wolfram Web Resource. http://mathworld.wolfram.com/SurfaceofRevolution.html, downloaded on Apr. 11, 2005, 12 pp.

Weisstein, Eric W., "Fractal." From MathWorld—A Wolfram Web Resource. http://mathworld.wolfram.com/Fractal.h, downloaded Apr. 13, 2006, 3 pp.

Weisstein, Eric W. et al., "Fibonacci Number." From MathWorld—A Wolfram Web Resource. http://mathworld.wolfram.com/FibonacciNumber.html, downloaded on Apr. 14, 2006, 15 pp.

Cox, T.J. and D'Antonio, P., "Optimized Planar and Curved Diffsorbors", Sep. 1999, 13 pp., downloaded from www.rpginc.com on Aug. 8, 2003.

D'Antonio, P. and Cox, T.J., "Technical Bulletin on the Application of Diffusion in Critical Listening Rooms", Jan. 2003, 9 pp., downloaded from www.rpginc.com on Aug. 8, 2003.

RPG Diffusor Systems, product description of Golden Pyramid(TM) Product, 8 pp., downloaded from www.rpginc.com on Aug. 9, 2003.

RPG Diffusor Systems, product description of OptiCurve(TM) Product, 3 pp., downloaded from www.rpginc.com on Aug. 9, 2003.

RPG Diffusor Systems, "Concave Surface Optimization", 3 pp., downloaded from http://www.rpginc.com/research/cso.htm on Jul. 24, 2008 (originally viewed on Aug. 8, 2003).

RPG Diffusor Systems, "Intelligent Shape Optimization", 2 pp., downloaded from http://www.rpginc.com/research/iso.htm on Jul. 24, 2008 (originally viewed on Aug. 8, 2003).

RPG Diffusor Systems, "Stage Canopy Optimization—Part I", 3 pp., downloaded from http://www.rpginc.com/research/scs1.htm on Jul. 24, 2008 (originally viewed on Aug. 8, 2003).

RPG Diffusor Systems, "Stage Canopy Optimization—Part II", 3 pp., downloaded from http://www.rpginc.com/research/scs2.htm on Jul. 24, 2008 (originally viewed on Aug. 8, 2003).

RPG Diffusor Systems, "Stage Canopy Optimization—Part III", 3 pp., downloaded from http://www.rpginc.com/research/scs3.htm on Jul. 24, 2008 (originally viewed on Aug. 8, 2003).

RPG Diffusor Systems, "Overhead Canopy Design: Evaluating periodic semicylinder arrays", diffuse Bulletin, vol. 1, Issue 6, 2004, 1 p., downloaded from http://www.rpginc.com/diffusebulletin/pdfs/dbv1i6.pdf on Jul. 24, 2008.

RPG Diffusor Systems, "Overhead Canopy Design: Shape Optimization", diffuse Bulletin, vol. 1, Issue 7, 2004, 1 p., downloaded from http://www.rpginc.com/diffusebulletin/pdfs/dbv1i7.pdf on Jul. 24, 2008.

RPG Diffusor Systems, "Overhead Canopy Design: Shape Optimization Continued", diffuse Bulletin, vol. 1, Issue 8, 2004, 1 p., downloaded from http://www.rpginc.com/diffusebulletin/pdfs/dbv1i8.pdf on Jul. 24, 2008.

RPG Diffusor Systems, "Overhead Canopy Design: Aperiodic Modulation", diffuse Bulletin, vol. 1, Issue 9, 2004, 1 p., downloaded from http://www.rpginc.com/diffusebulletin/pdfs/dbv1i9.pdf on Jul. 24, 2008.

RPG Diffusor Systems, "Overhead Canopy Design: Optimized Canopy Design: Evaluating Existing Shapes", diffuse Bulletin, vol. 1, Issue 10, 2004, 1 p., downloaded from http://www.rpginc.com/diffusebulletin/pdfs/dbv1i10.pdf on Jul. 24, 2008.

RPG Diffusor Systems, "Overhead Canopy Design: 1D Optimized Spline", diffuse Bulletin, vol. 1, Issue 12, 2004, 1 p., downloaded from http://www.rpginc.com/diffusebulletin/pdfs/dbv1i12.pdf on Jul. 24, 2008.

RPG Diffusor Systems, "Overhead Canopy Design: 2D Optimized Bicubic", diffuse Bulletin, vol. 1, Issue 13, 2004, 1 p., downloaded from http://www.rpginc.com/diffusebulletin/pdfs/dbv1i13.pdf on Jul. 24, 2008.

RPG Diffusor Systems, "Overhead Canopy Design: Custom Canopy Installations", diffuse Bulletin, vol. 1, Issue 14, 2004, 1 p., downloaded from http://www.rpginc.com/diffusebulletin/pdfs/dbv1i14.pdf on Jul. 24, 2008.

PCT International Search Report in International Application No. PCT/US06/13992, Nov. 22, 2006, 4 pp.

PCT International Search Report in International Application No. PCT/US06/13992, Nov. 22, 2006, 6 pp.

* cited by examiner

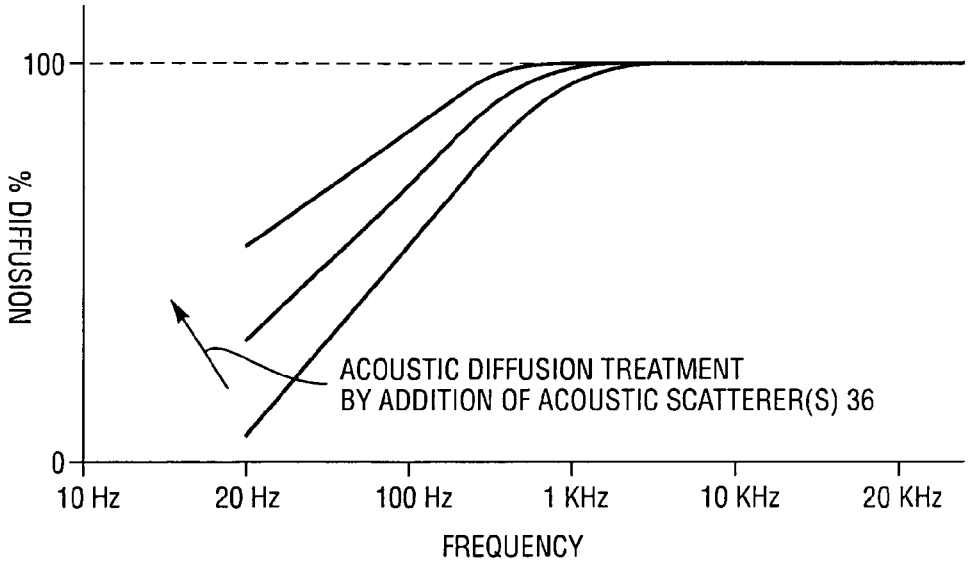
Fig. 3
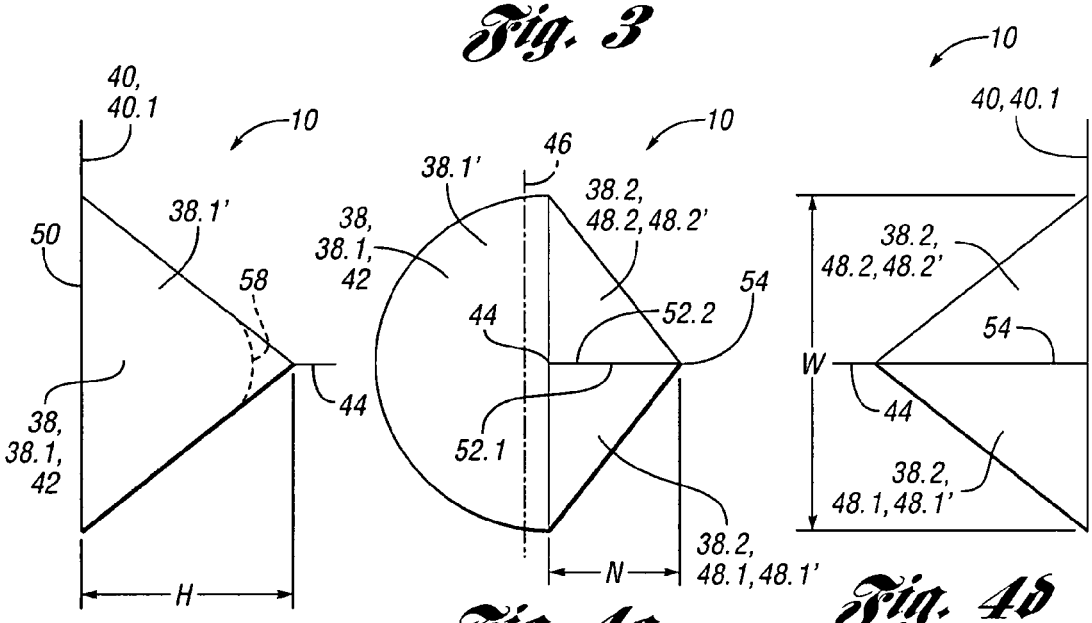
Fig. 4c
Fig. 4a
Fig. 4b
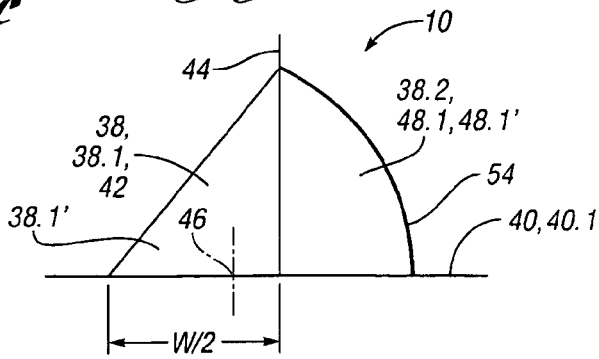
Fig. 4b

| | Ceiling | | Wall | | | Element Dimensions (inches) | | | | Ratios | | | | | | c_ft/sec 1127 | |
|---|---|---|---|---|---|---|---|---|---|---|---|---|---|---|---|---|---|
| # | ID | TYPE | ID | TYPE | ID | Height H | Width W | Nose N | D= N+W/2 | H | W | N | D/W | f_lo Hz | f_hi KHz | lambda L_in | H/L |
| 1 | A' | Full | A' | Full | A | 0.466 | 0.754 | 0.288 | 0.665 | | | | 0.882 | 15,000 | 20 | 0.902 | 0.52 |
| 2 | B' | Full | B' | Full | B | 0.754 | 1.22 | 0.466 | 1.08 | 1.618 | 1.618 | 1.618 | 0.882 | 9,000 | 20 | 1.50 | 0.50 |
| 3 | D' | Full | C' | Full | C | 1.22 | 1.97 | 0.754 | 1.74 | 1.618 | 1.618 | 1.618 | 0.882 | 5,500 | 20 | 2.46 | 0.50 |
| 4 | E' | Full | E' | Full | D | 1.97 | 3.19 | 1.22 | 2.82 | 1.618 | 1.618 | 1.618 | 0.882 | 3,500 | 20 | 3.86 | 0.51 |
| 5 | F' | Full | | Full | E | 3.19 | 5.17 | 1.97 | 4.56 | 1.618 | 1.618 | 1.618 | 0.882 | 2,100 | 20 | 6.44 | 0.50 |
| 6 | H' | Full | G' | Full | F | 5.17 | 8.36 | 3.19 | 7.37 | 1.618 | 1.618 | 1.618 | 0.882 | 1,300 | 20 | 10.4 | 0.50 |
| 7 | | Full | | Full | G | 8.36 | 13.5 | 5.17 | 11.9 | 1.618 | 1.618 | 1.618 | 0.882 | 815 | 20 | 16.6 | 0.50 |
| 8 | | Full | H' | Full | H | 13.5 | 21.9 | 8.36 | 19.3 | 1.618 | 1.618 | 1.618 | 0.882 | 500 | 20 | 27.0 | 0.50 |
| 9 | I' | Full | I' | Partial | I | 21.9 | 35.4 | 13.5 | 31.2 | 1.618 | 1.618 | 1.618 | 0.882 | 310 | 20 | 43.6 | 0.50 |
| 10 | J' | Partial | J' | Partial | J | 35.4 | 57.3 | 21.9 | 50.5 | 1.618 | 1.618 | 1.618 | 0.882 | 190 | 20 | 71.2 | 0.50 |
| 11 | K' | Partial | N' | Partial | K | 57.3 | 92.7 | 35.4 | 81.8 | 1.618 | 1.618 | 1.618 | 0.882 | 118 | 20 | 115 | 0.50 |
| 12 | | | | | L | 92.7 | 150 | 57.3 | 132 | 1.618 | 1.618 | 1.618 | 0.882 | 73 | 20 | 185 | 0.50 |
| 13 | | | | | M | 150 | 243 | 92.7 | 214 | 1.618 | 1.618 | 1.618 | 0.882 | 44 | 20 | 307 | 0.49 |
| 14 | | | | | N | 243 | 393 | 150 | 346 | 1.618 | 1.618 | 1.618 | 0.882 | 28 | 20 | 483 | 0.50 |

Fig. 7

| Effective Diffuser Element Width W | | | | | | | |
|---|---|---|---|---|---|---|---|
| NP = Number of Intermediate Panels | | | | | | | |
| | | Panel Length = 92.7"+ δ | | | | | |
| | W | 0 | | 1 | | 2 | |
| I | 35.4 | $I_1$ | 128.1+δ | $I_2$ | 220.8+2δ | $I_3$ | 313.5+3δ |
| J | 57.3 | $J_1$ | 150.0+δ | $J_2$ | 242.7+2δ | $J_3$ | 335.4+3δ |
| K | 92.7 | $K_1$ | 185.4+δ | $K_2$ | 278.1+2δ | $K_3$ | 370.8+3δ |

ACOUSTIC SCATTERER

CROSS-REFERENCE TO RELATED APPLICATIONS

The instant application claims the benefit of prior U.S. Provisional Application Ser. No. 60/671,402 filed on Apr. 14, 2005, which is incorporated herein by reference.

BRIEF DESCRIPTION OF THE DRAWINGS

In the accompanying drawings:

FIG. 3 illustrates a characterization of acoustic scatterer performance within a room;

FIGS. 4*a-d* illustrate plan, side and first and second end views of a first embodiment of an acoustic scatterer element;

FIGS. 5*a-d* illustrate plan, side and first and second end views of a second embodiment of an acoustic scatterer element;

FIG. 7 illustrates a table of various acoustic scatterer elements in accordance with the first embodiment of the acoustic scatterer element, used in various embodiments of associated acoustic scatterer panels;

DESCRIPTION OF EMBODIMENT(S)

Figure 1:
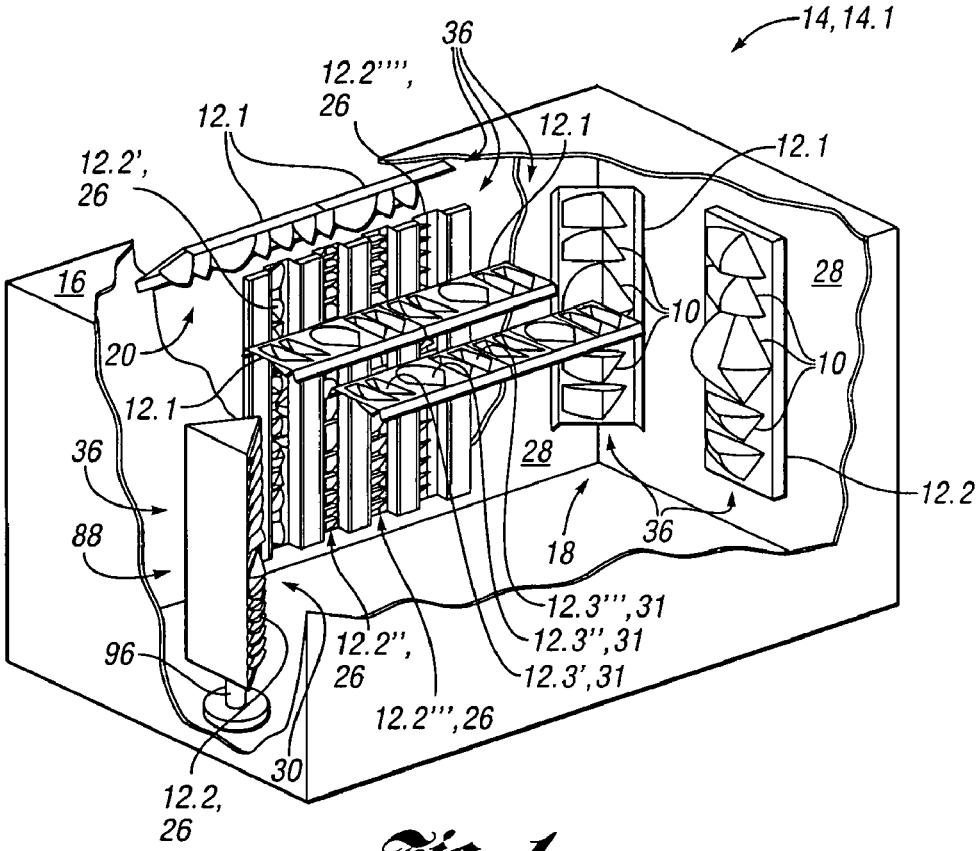
FIG. 1 illustrates an isometric view of a first room with various acoustic treatments using various embodiments of acoustic scatterers.
Figure 2:
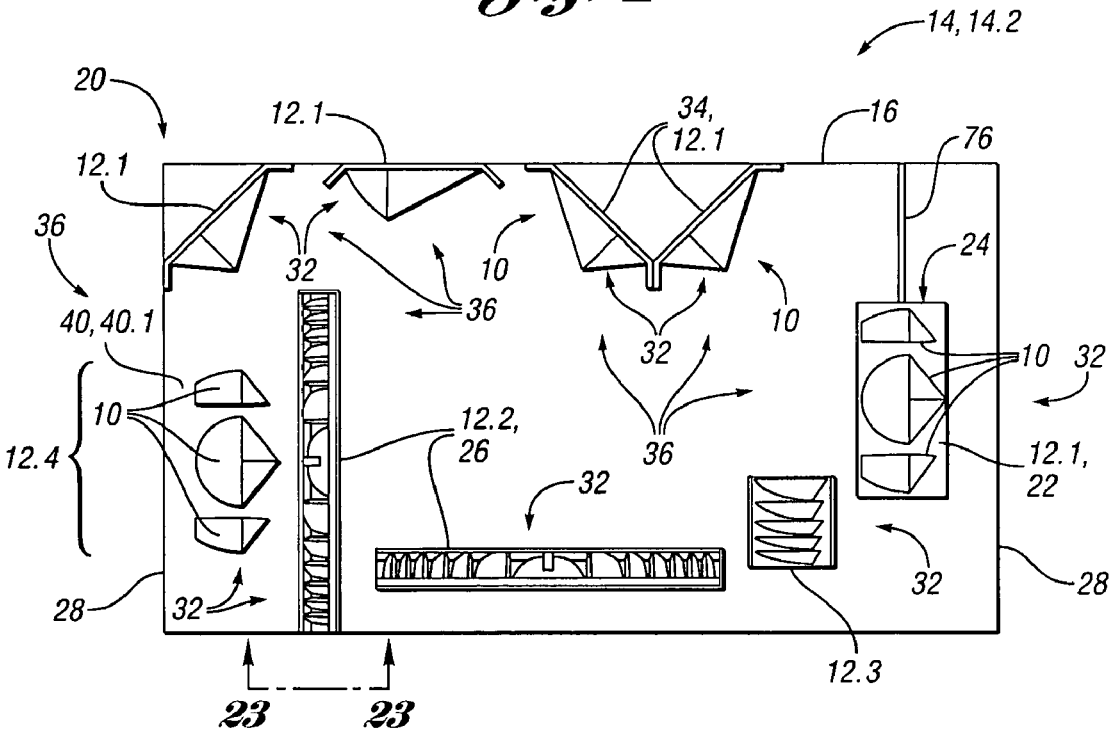
FIG. 2 illustrates an end view within a second room with various acoustic treatments using various embodiments of acoustic scatterers.

Referring to FIGS. 1 and 2, a plurality of acoustic scatterer elements 10 are incorporated in various embodiments of associated scatterer panels 12 located within respective first 14.1 and second 14.2 rooms so as to provide for acoustic compensation and tuning thereof. For example, various embodiments of a first aspect of a scatterer panel 12.1 are illustrated along the ceiling 16, along a wall corner 18, along a ceiling corner 20 of the first 14.1 and second 14.2 rooms, and as faces 22 of an acoustic chandelier 24. In accordance with the first aspect, the scatterer panel 12.1 comprises a self-contained full set of acoustic scatterer elements 10 that provide for acoustic diffusion over an associated range of frequencies. Various embodiments of a second aspect of a scatterer panel 12.2, 12.2', 12.2", 12.2''', 12.2'''', comprising longitudinally sectionalized portions 26 of associated full sets of acoustic scatterer elements 10, are illustrated along and recessed within the walls 28, and in a rotatable acoustic tuning unit 30 standing within the first room 14.1. Various embodiments of a third aspect of a scatterer panel 12.3, 12.3', 12.3", 12.3''', comprising transversely sectionalized portions 31 of associated full sets of acoustic scatterer elements 10, are illustrated recessed within the ceiling 16 of the first room 14.1, and on a wall 28 of the second room 14.2. Referring to FIG. 2, in accordance with a fourth aspect of a scatterer panel 12.4, various acoustic scatterer elements 10 are, for example, attached, e.g. by bonding, fastening, or vacuum, electrostatic or magnetic attachment directly to, or a part of, a wall 28.

The acoustic scatterer elements 10 extend from a face of the associated scatterer panel 12, or wall 28, so as to define an associated acoustic scatterer surface 32 thereof, which faces towards the interior of the associated room 14. Referring to FIG. 2, a pair 34 of scatterer panels 12.1—each in accordance with the first aspect—extend from the ceiling 16 and abut one another, and are arranged so that their respective acoustic scatterer surfaces 32 face in different directions, for example, each at an angle of approximately 45 degrees relative to the surface of the ceiling 16.

Referring to FIG. 3, it is generally desirable for the acoustics of a room 14 to be such that the sound therein is scattered, diffused or dispersed, so as to mitigate against standing waves or other concentrations of sound energy. An acoustic scatterer 36 provides for disrupting acoustic waves within a room 14 by providing for destructive interference thereof upon reflection from the associated acoustic scatterer surfaces 32 and combination with the associated incoming sound waves, wherein the acoustic scatterer surfaces 32 provide for redirecting the acoustic waves upon reflection so as to cause the associated phase shifts necessary for destructive interference. As illustrated in FIG. 3, the amount of acoustic diffusion in the room 14—e.g. as measured by the modal characteristics of the associated acoustic energy, wherein 100% diffusion would correspond to a uniform sound energy throughout the room 14—generally falls off with decreasing acoustic frequency, and the acoustic scatterers 36 described herein provide for increasing the amount of diffusion in the room 14 at all frequencies including the lower frequencies. For example, FIG. 3 illustrates an increase in acoustic diffusion as acoustic scatterers 36 are incorporated in a room 14.

Referring to FIGS. 4*a-d*, a first embodiment of an acoustic scatterer element 10 comprises a plurality of different convex surfaces 38 extending from a reference surface 40, for example, a planar reference surface 40.1. Conical surfaces have been found to be beneficial for providing for acoustic dispersion, as has been asymmetric configurations or relationships thereof. For example, in one embodiment, a first convex surface 38.1 comprises a first substantially conical surface 42 about a first axis 44, i.e. a surface of revolution, wherein, for example, the first axis 44 is substantially normal to the reference surface 40. At least one second convex surface 38.2 abuts the first convex surface 38.1, and the second convex surface 38.2 is curved about a corresponding at least one second axis 46 that is oriented in a different direction relative to the first axis 44. For example, in one embodiment, the second axis 46 is at a substantial angle, e.g. normal, relative to the first axis 44. For example, in the embodiment illustrated in FIGS. 4*a-d*, the at least one second convex surface 38.2 comprises first 48.1 and second 48.2 swept surfaces, e.g. surfaces of revolution, e.g. conical (e.g. third 48.1' and fourth 48.2' conical surfaces) or substantially conical or ellipto-conical, that are swept about a second axis 46 that is substantially normal to the first axis 44, wherein the base 50 of the first substantially conical surface 42 abuts the reference surface 40, and the respective bases 52.1, 52.2 of the first 48.1 and second 48.2 swept surfaces abut one another and are substantially co-planar with the first axis 44. The first 48.1 and second 48.2 swept surfaces extend from the first axis 44 by a nose depth N so as to form a nose 54 of the acoustic scatterer element 10. In one set of embodiments, the acoustic scatterer element 10 is adapted so that the ratio the width W thereof to the height H thereof is substantially equal to the golden ratio as defined by the Fibonacci number, and the ratio of the height H to the nose depth N is also substantially equal to the golden ratio, wherein the Fibonacci number is defined as the solution to the equations $x^2-x-1=0$, and is approximately equal to 1.618. Referring to FIG. 4*c*, the top 56 of the acoustic scatterer element 10 may be rounded 58, for example, with a smooth transition to the adjoining adjacent first substantially conical surface 42 and first 48.1 and second 48.2 swept surfaces, for example, so as to provide for reducing the height H of the acoustic scatterer element 10, for example for either esthetic reasons or because of space constraints. Generally, the acoustic scatterer element 10 extending from the reference surface 40 is convex so as to promote dispersion of acoustic waves impinging thereupon, and to preclude a focusing thereof. Generally, the first convex surface 38.1 may also comprise a swept surface 38.1', e.g. substantially conical or ellipto-conical, that is swept, or revolved, about the first axis 44. Furthermore, the associated swept surfaces 38.1', 48.1, 48.2 may be adapted to incorporate a contour that varies with the associated sweep angle.

Figures 5A, 5B, 5C:
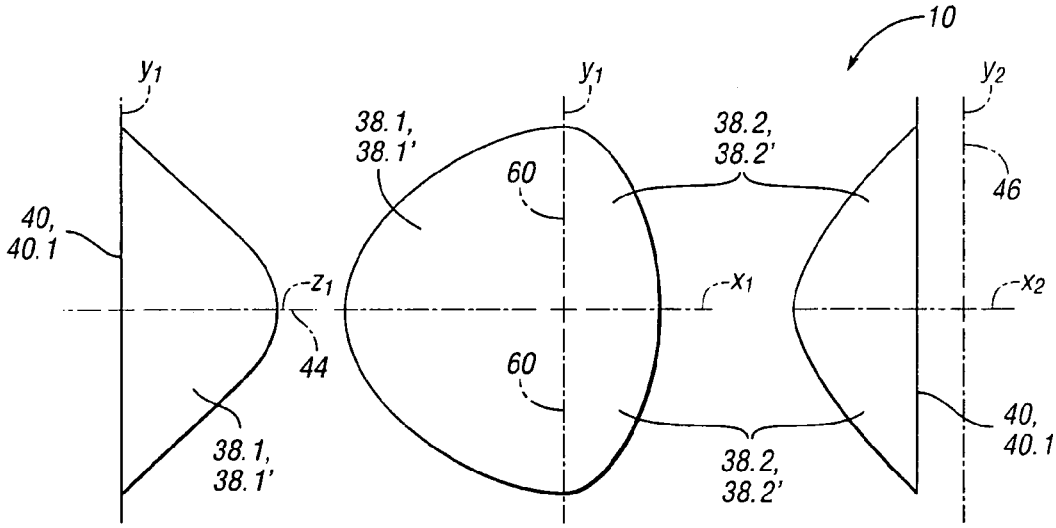
Figure 5B:
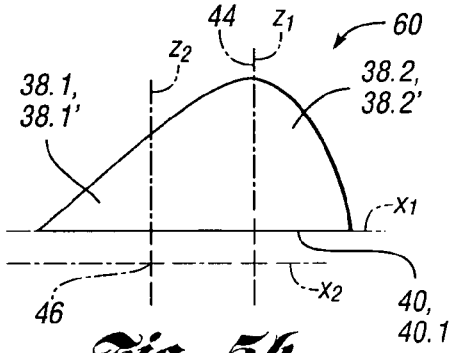
Figure 6:
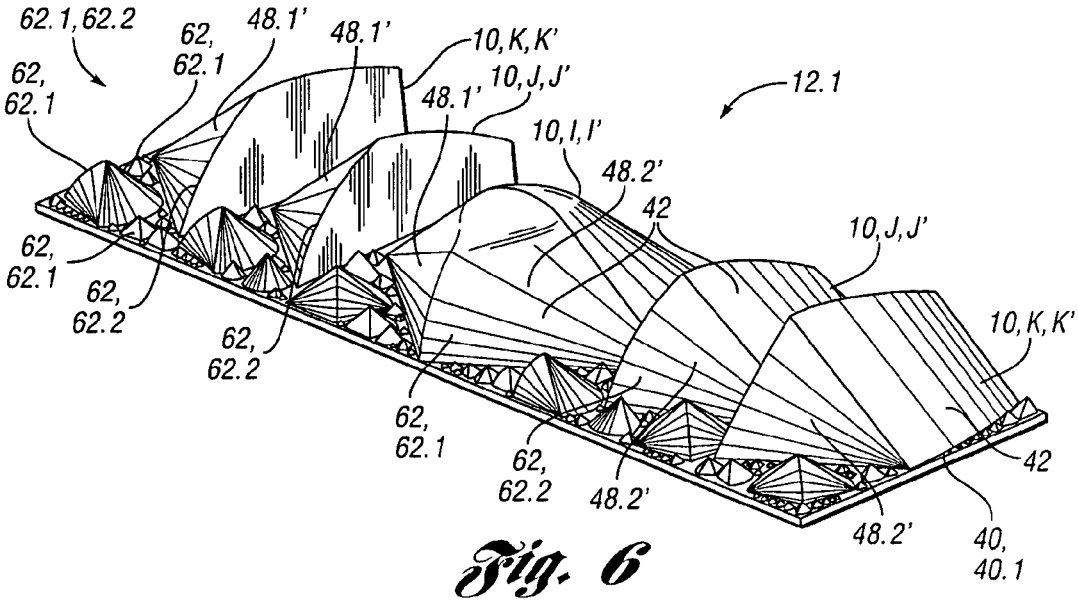
FIG. 6 illustrates an isometric view of a first embodiment of a first aspect of an acoustic scatterer panel.

Referring to FIGS. 5*a-d*, in accordance with a second embodiment of an acoustic scatterer element 10, the at least one second convex surface 38.2 comprises an ellipsoidal surface 38.2' that is convexly blended in a transition zone 60 with the first convex surface 38.1 comprising a generally swept surface 38.1', wherein the major and minor axes of the ellipsoidal surface 38.2' are along the $y_2$ axis illustrated in FIG. 5*d*, and the $z_2$ axis illustrated in FIG. 5*b*, respectively, of the $x_2$, $y_2$, $z_2$ coordinate system; and the first convex surface 38.1 is swept about the $z_1$ axis illustrated in FIGS. 5*b* and 5*c*, of the $x_1$, $y_1$, $z_1$ coordinate system.

Referring to FIGS. 6-11, in accordance with a first embodiment of the first aspect of the scatterer panel 12.1, a plurality of acoustic scatterer elements 10, of various sizes in accordance with the table of FIG. 7, and various orientations as illustrated in FIGS. 6, 10*a*, 10*b*, and 11, are combined, wherein, for example, the differently sized acoustic scatterer elements 10 are scaled with respect to one another in accordance with the golden ratio, so as to provide a quasi-fractal arrangement of acoustic scatterer elements 10, which are also referred to herein as fractals 62. Generally, each fractal comprises an acoustic scatterer element 10 as illustrated in FIGS. 4*a-d* or 5*a-d*, and different fractals are sized differently, and can be oriented differently, so as to provide for correspondingly different acoustic dispersion characteristics, the ensemble in combination adapted to increase acoustic diffusion within the associated room.

Referring to FIG. 7, the nominal fractals 62 are designated with a letter identifier ID of A-N, which refers to the size of the associated fractal 62. For each fractal 62, the ratios of the nominal width W to the nominal height H, and the nominal height H to the nominal nose depth N, are nominally equal to the Fibonacci number (nominally 1.618). Furthermore, in the sequence of fractals A-N, the nominal height H, nominal width W or nominal nose depth N of a succeeding larger fractal 62 is larger than the corresponding dimension of the preceding smaller fractal 62 also by the Fibonacci number (nominally 1.618). For example, the smallest indicated fractal 62, A has a nominal height H=0.466 inches, nominal width W=0.754 inches and a nominal nose depth N=0.288 inches. The next larger indicated fractal 62, B has nominal height H=0.754 inches, nominal width W=0.1.22 inches and a nominal nose depth N=0.466 inches, each of which dimensions is larger by a nominal factor of 1.618 relative to the smaller fractal 62, A. Furthermore, the nominal height H of the succeeding larger fractal 62, B is nominally equal to the nominal width W of the preceding smaller fractal 62, A, and the nominal nose depth N of the succeeding larger fractal 62, B is nominally equal to the nominal height H of the preceding smaller fractal 62, A. These relationships continue for fractal C relative to fractal B, fractal D relative to fractal C, and so on.

The acoustic frequency range over which a particular fractal 62 is effective is determined principally by the size thereof. More particularly, a practical lower bound on frequencies for which a particular fractal 62 can be relied upon for acoustic dispersion is a frequency whose wavelength is about twice the height H of the fractal 62. Accordingly, the table of FIG. 7 also lists the frequencies corresponding to each of the fractals 62 tabulated therein, wherein the wavelength lamda L_in in inches corresponds to the lower frequency f_lo Hz in Hertz for a speed of sound c of 1127 ft/sec, and the ratio H/L of the height H of the fractal 62 to the wavelength lamda L_in of the lower frequency f_lo Hz is about 0.5. Accordingly, in selecting the nominal sizes of the fractals 62, one can either begin with an upper bound on the lower frequency f_lo Hz to be dispersed, which will in turn yield the size of the smallest fractal 62 of the associated scatterer panel 12, or one could begin with a selection of the size of the largest or smallest fractal 62 of the associated scatterer panel 12 (or any other fractal 62 thereof), from which would be determined the associated lower frequency f_lo Hz for each of the resulting fractals 62 scaled therefrom, for example, in accordance with the scaling relationships disclosed hereinabove and incorporated in the table of FIG. 7. For example, instead of a starting height H of 0.47 inches for the smallest fractal 62, the starting height of the smallest fractal could have been 0.5 inches or 0.25 inches, for example, although a height H much smaller that the nominal 0.47 inches would not be expected to affect even a 20 KHz acoustic wave.

It should be understood that although the entries of the table of FIG. 7 provide nominal values based upon a Fibonacci scaling as an example of one possible class of embodiments, in practice the succeeding fractals 62 need not be uniformly scaled from one fractal 62 to another, and that the nominal scaling factor used to scale the succeeding fractals 62 need not necessarily be equal to the Fibonacci number. Furthermore, the diffusion process is also responsive to the width W of the fractals 62, and the nose depth N thereof, and because the width W of each fractal 62 is somewhat larger than the height H, the affect thereof on, or relationship thereof to, the associate acoustic frequencies would be expected to be linear over a greater range of frequencies that would result from using just height H as the reference.

Figure 10A:
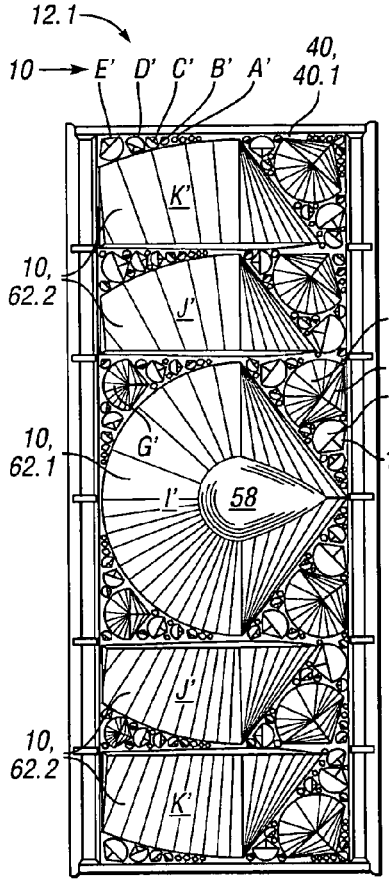
FIGS. 10*a-c* illustrates a plan view image, plan view outline and side view of the first embodiment of the first aspect of the acoustic scatterer panel.
Figure 10B:
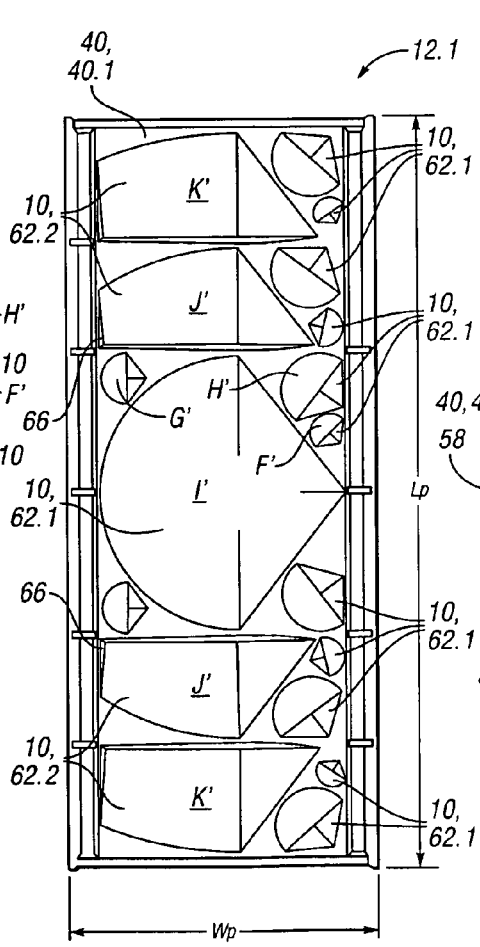
Figure 10C:
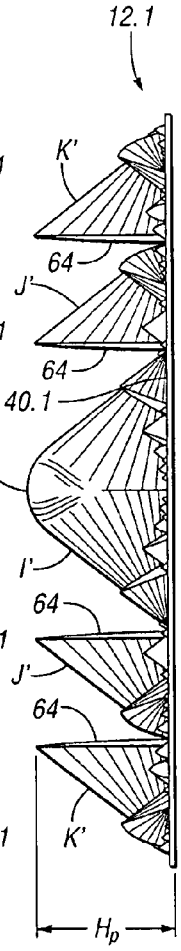

In practice, the overall size of an associated scatterer panel 12 incorporating the plurality of fractals 62 thereon is limited, for example, for aesthetic reasons or because of size limitations. The scatterer panel 12 extends into the space of the room 14 by a distance equal to the height H of the largest fractal 62. In accordance with the first embodiment of the first aspect of the acoustic scatterer panel 12.1—which was adapted for ceiling 16 applications—the associated height Hp of the acoustic scatterer panel 12.1 was arbitrarily limited to 18 inches, which limited the size of the largest full fractal 62.1 thereof from the table of FIG. 7 to be fractal I—which has a nominal height H of 21.9 inches—as illustrated in FIGS. 10*a-c*, and which was rounded 58 to satisfy the height Hp constraint. The length $L_P$ and width $W_P$ of this first embodiment of the first aspect of the acoustic scatterer panel 12.1 were set at 88 inches and 37 inches, respectively, for arbitrary practical reasons. Accordingly, the largest fractal 62, from the table of FIG. 7, whose width W could most closely fit within the length $L_P$ constraint was then fractal K. However, fractals J and K substantially exceed the given size limitations (i.e. the above-described 18 inch height $H_P$ limitation) of this first embodiment of the first aspect of the acoustic scatterer panel 12.1.

Figure 8:
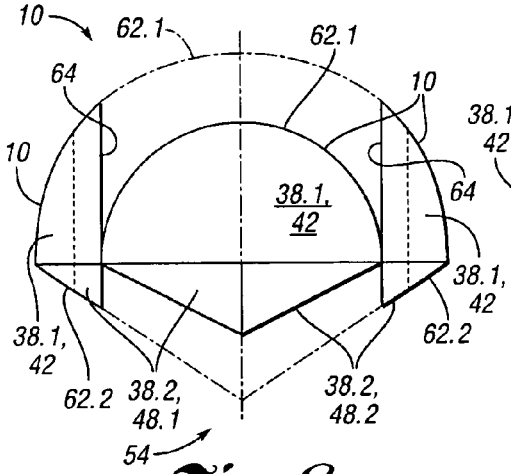
FIG. 8 illustrates a plan view of a first aspect of a combination of full and partial acoustic scatterer elements.
Figure 9:
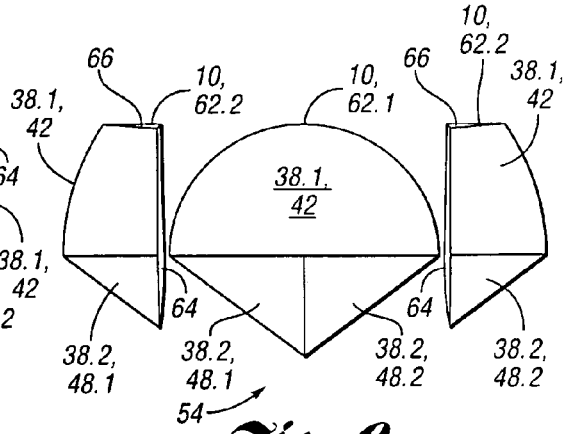
FIG. 9 illustrates a plan view of a second aspect of a combination of full and partial acoustic scatterer elements.

Referring to FIG. 8, in accordance with a first aspect, the fractals 62 larger than the associated design constraints of the associated scatterer panel 12 can be incorporated therein by substantially co-locating these fractals 62 with the largest full fractal 62.1, and then removing the center portion of the larger fractal 62 so that the remaining portions of the resulting partial fractal 62.2 span the next smaller fractal 62, 62.1. In one embodiment, the inboard faces 64 of the resulting partial fractal 62.2 are substantially planar with about a 3 degree draft angle so as to facilitate manufacture of the acoustic scatterer panel 12.1 by molding. Referring to FIG. 9, in accordance with a second aspect, a portion of the first convex surface 38.1 of each partial fractal 62.2 is clipped so that the remaining partial fractal 62.2 fits within the width $W_P$ of the acoustic scatterer panel 12.1. Accordingly, the resulting partial fractal 62.2 incorporates longitudinal face portions 66, which can also be adapted with a draft angle to facilitate manufacture.

Referring to FIGS. 10*a-c*, in accordance with the first embodiment of the first aspect of the acoustic scatterer panel 12.1, a plurality of acoustic scatterer elements 10 identified as fractals A' through K' are incorporated therein, wherein fractals A' through I' are full fractals 62.1, and fractals J' and K' are partial fractals (in accordance with the second aspect illustrated in FIG. 9), all located as indicated in FIGS. 10*a* and 10*b*. The fractals 62, A'-K' of FIG. 10 are cross-referenced to the nominal fractals tabulated in FIG. 7, under the tabular columns thereof labeled "Ceiling". Accordingly, it will be observed that not all of the nominal fractals 62, A-K from the table of FIG. 7 are included in the first embodiment of the first aspect of the acoustic scatterer panel 12.1. More particularly, it will be observed that nominal fractals G and H are missing, and that first embodiment of the first aspect of the acoustic scatterer panel 12.1 includes fractals C' and G' that are intermediate to the nominal fractals 62, A-K from the table of FIG. 7. These modifications from the nominal set of fractals 62, A-K from the table of FIG. 7 were made because of practical considerations, for example, because fractals G and H could not fit within the portions of the first embodiment of the first aspect of the acoustic scatterer panel 12.1 that were available after incorporating fractals I, J and K.

Figure 11:
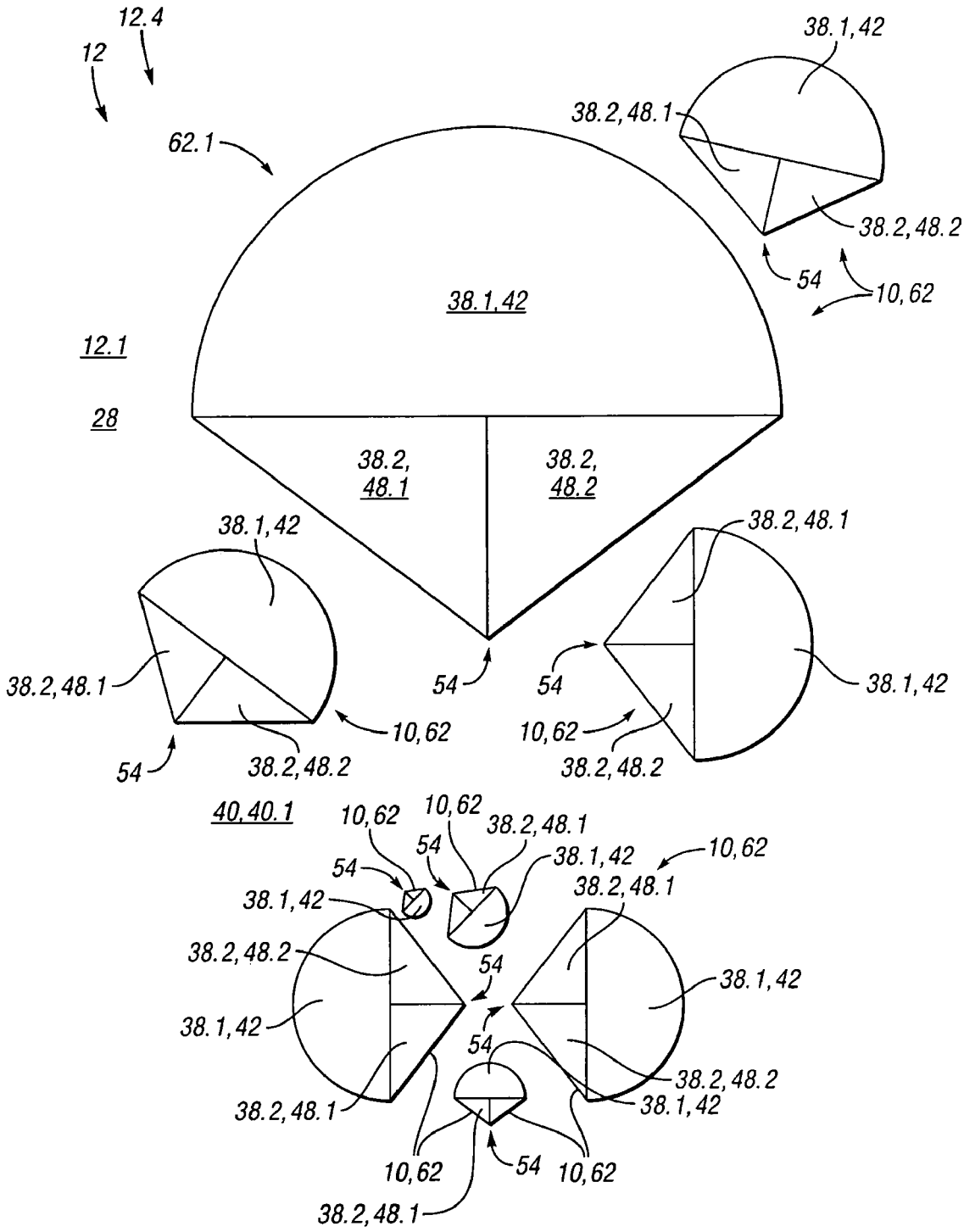
FIG. 11 illustrates various arrangements of various acoustic scatterer elements either of a portion of a prospective acoustic scatterer panel or on a wall surface.
Figures 12A, 12B:
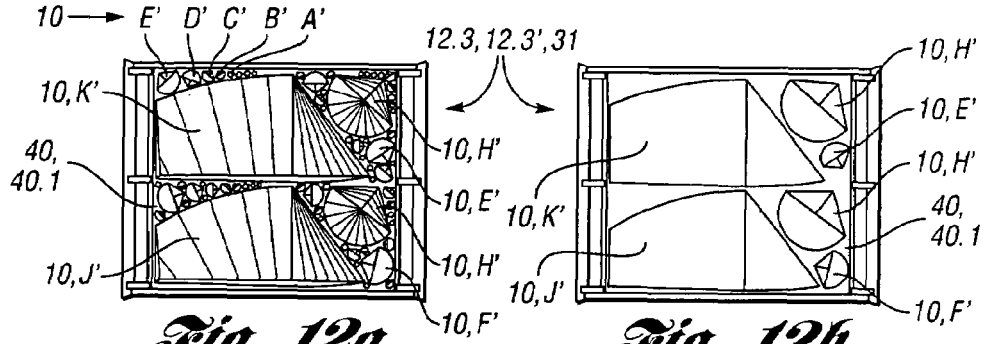
FIGS. 12*a* and 12*b* illustrate a plan view image and plan view outline of a first section/embodiment of a sectionalized acoustic scatterer panel in accordance with a third aspect.
Figures 13A, 13B:
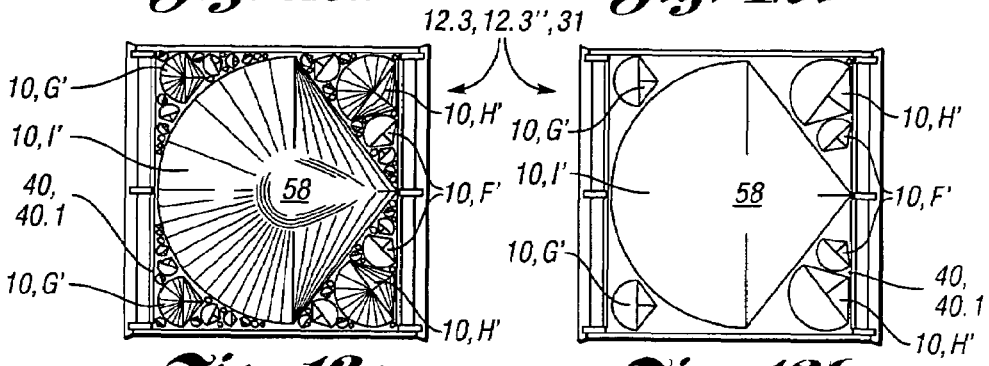
FIGS. 13*a* and 13*b* illustrate a plan view image and plan view outline of a second section/embodiment of a sectionalized acoustic scatterer panel in accordance with the third aspect.
Figures 14A, 14B:
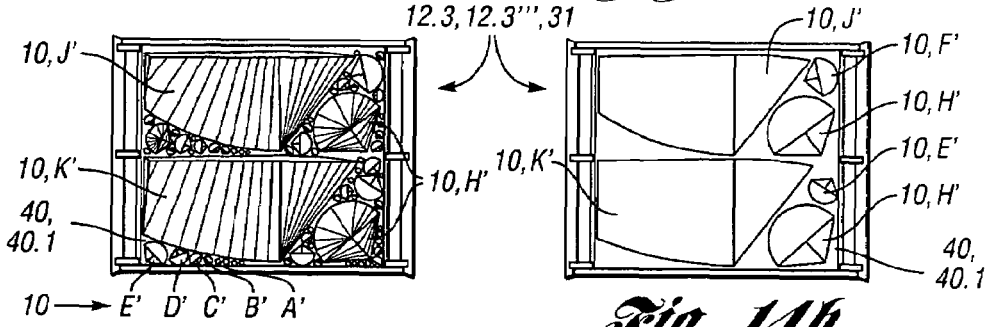
FIGS. 14*a* and 14*b* illustrate a plan view image and plan view outline of a third section/embodiment of a sectionalized acoustic scatterer panel in accordance with the third aspect.

After placement of the partial fractals 62.2, J', K' and the largest full fractal 62.1, I' in the first embodiment of the first aspect of the acoustic scatterer panel 12.1, the remaining smaller full fractals 62.1, A'-H' were located in the remaining available space. Referring to FIG. 11, the positioning of these full fractals 62.1, A'-H' is somewhat arbitrary, with the view to creating as much chaos or asymmetry as possible, wherein the fractals 62 of different sizes are interspersed with one another at various orientations. For example, in accordance with one aspect, the various fractals 62 are oriented so as to create a fractal pattern that is substantially independent of scale. The fractals 62 exhibit front to back asymmetry, wherein the nose 54 differs in shape from that of the first convex surface 38.1. Accordingly, in accordance with one aspect, the fractals 62 are oriented so that either dissimilar shape portions thereof are oriented towards one another, or dissimilar sized fractals 62 are located proximate to one another, so as to promote chaotic scattering of reflected acoustic waves. Manufacturing considerations may also guide the placement and orientation of the fractals 62, although to a substantially lesser degree.

The first embodiment of the first aspect of the acoustic scatterer panel 12.1 provides for diffusing acoustic energy in the high, middle and low frequency ranges, and is suitable for application to ceilings 16, walls 28 or acoustic chandeliers 24. For example, a plurality of acoustic scatterer panels 12.1 in accordance with the first embodiment of the first aspect, in cooperation with one another, can provide for effective scattering and diffusion of acoustic energy for frequencies at or below 30 Hertz at the low range of human hearing.

Referring to FIGS. 12*a* and 12*b*, 13*a* and 13*b*, and 14*a* and 14*b*, in accordance with the third aspect of an acoustic scatterer panels 12.3, the first aspect of the acoustic scatterer panel 12.1 is transversely sectionalized into corresponding transversely sectionalized portions 31 which are adapted to cooperate with one another as do the corresponding portions in the first aspect of the acoustic scatterer panel 12.1. For example, referring to FIGS. 12*a* and 12*b*, a first section/embodiment of a the third aspect of an acoustic scatterer panel 12.3' corresponds to a first end portion of the associated first embodiment of the first aspect of the acoustic scatterer panel 12.1; referring to FIGS. 13*a* and 13*b*, a second section/embodiment of a the third aspect of an acoustic scatterer panel 12.3" corresponds to a center portion of the associated first embodiment of the first aspect of the acoustic scatterer panel 12.1; and referring to FIGS. 14*a* and 14*b*, a third section/embodiment of a the third aspect of an acoustic scatterer panel 12.3'" corresponds to a second end portion of the associated first embodiment of the first aspect of the acoustic scatterer panel 12.1. The various acoustic scatterer panels 12.3', 12.3", 12.3'" may be used either individually or in cooperation with one another, for example, on or recessed in ceilings 16 or walls 28, including wall 18 and ceiling 20 corners. The operating frequency range of the third aspect of an acoustic scatterer panels 12.3 can be adapted so as to be similar to that of the first aspect of the acoustic scatterer panel 12.1.

Figures 15, 16, 17:
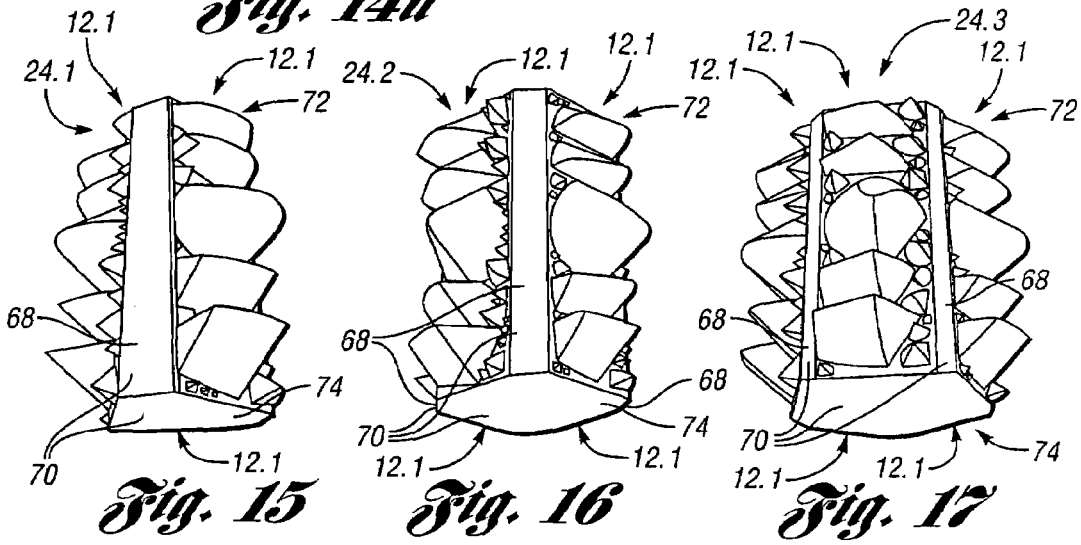
FIG. 15 illustrates a first embodiment of a chandelier style acoustic scatterer assembly.
FIG. 16 illustrates a second embodiment of a chandelier style acoustic scatterer assembly.
FIG. 17 illustrates a third embodiment of a chandelier style acoustic scatterer assembly.

Referring to FIGS. 15-17, the first embodiment of the first aspect of the acoustic scatterer panel 12.1 is illustrated on each of the faces of triangular 24.1, quadrilateral 24.2 and pentagonal 24.3 prismatic acoustic chandeliers, respectively, any of which can be hung from a ceiling 16 of a room 14 so as to increase the acoustic scattering and diffusion therein. The acoustic chandeliers 24.1, 24.2, 24.3 can be used individually alone, or in groups in combination with one another. In one embodiment, vertical gap regions 68 between the acoustic scatterer panel 12.1 are covered with perforated aluminum grills 70, as are the top 72 and bottom 74 of each acoustic chandelier 24.1, 24.2, 24.3. In one embodiment, the acoustic chandelier 24.1, 24.2, 24.3 is designed to be suspended from the ceiling 16 with a cable 76. The acoustic chandeliers 24.1, 24.2, 24.3 provide for broadband diffusion of modals or standing waves, and reverberation times can be adjusted by adding absorption materials within the center portions of the acoustic chandeliers 24.1, 24.2, 24.3.

Figure 18A:
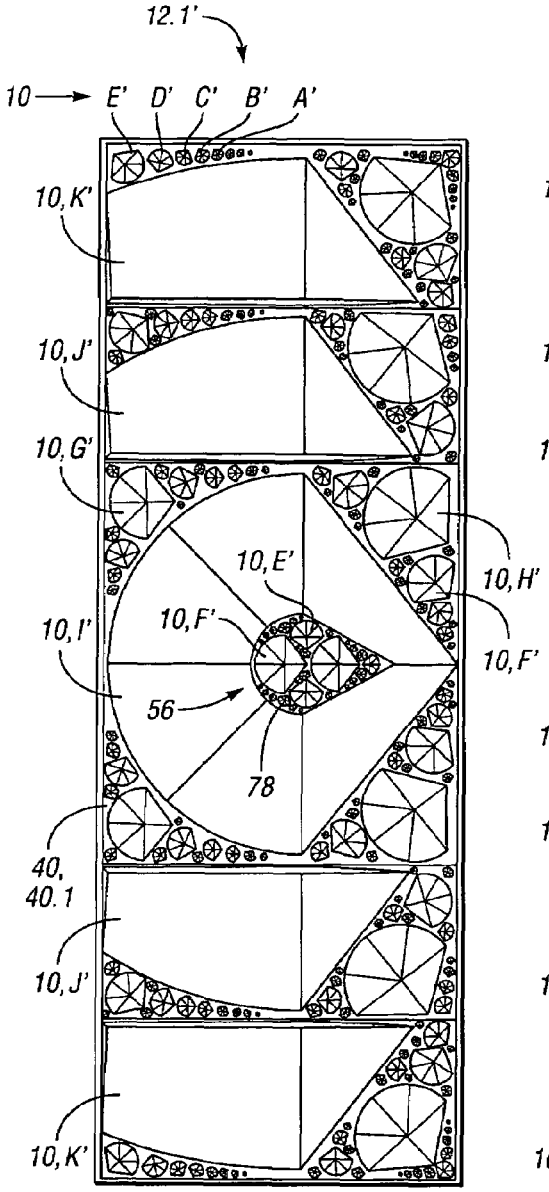
FIGS. 18*a* and 18*b* illustrate a second embodiment of the first aspect the acoustic scatterer panel.
Figure 18B:
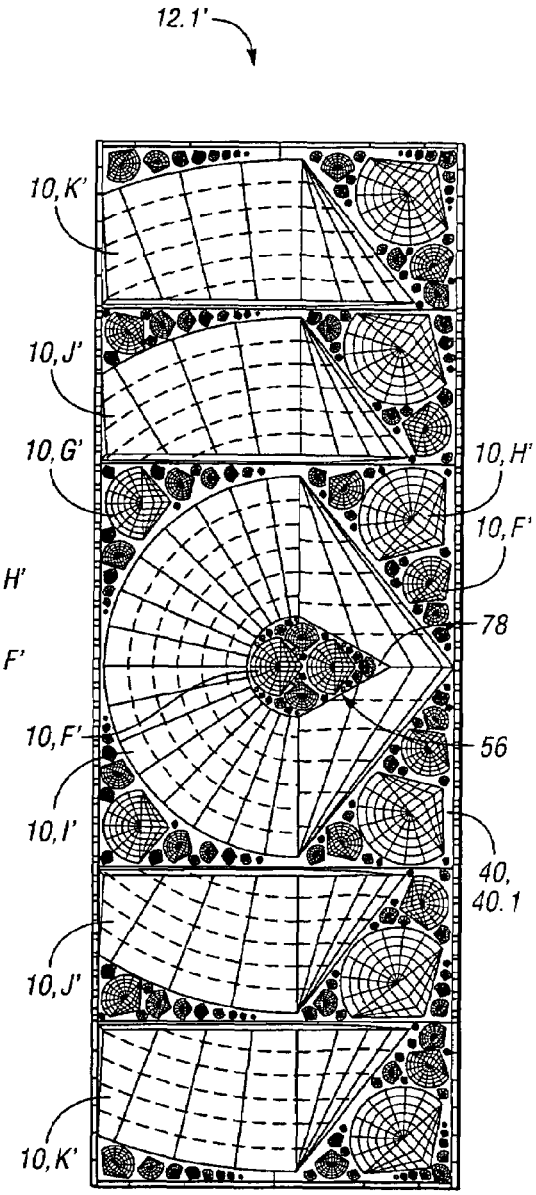

Referring to FIGS. 18*a* and 18*b*, in accordance with a second embodiment of the first aspect of the acoustic scatterer panel 12.1', the top 56 of the acoustic scatterer element 10 associated with the largest full fractal 62.1 incorporates a plateau 78 upon which additional smaller fractals 62 of various sizes are located in various orientations.

Figure 19A:
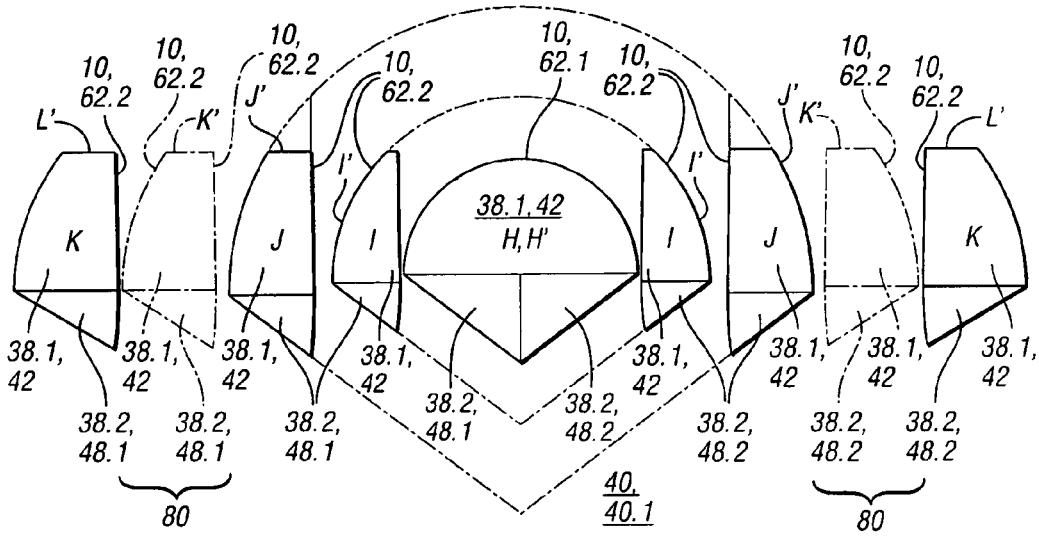
FIGS. 19*a* and 19*b* illustrate plan and side views respectively of an acoustic scatterer panel incorporating a truncation of some of the associated acoustic scatterer elements thereof.
Figure 19B:
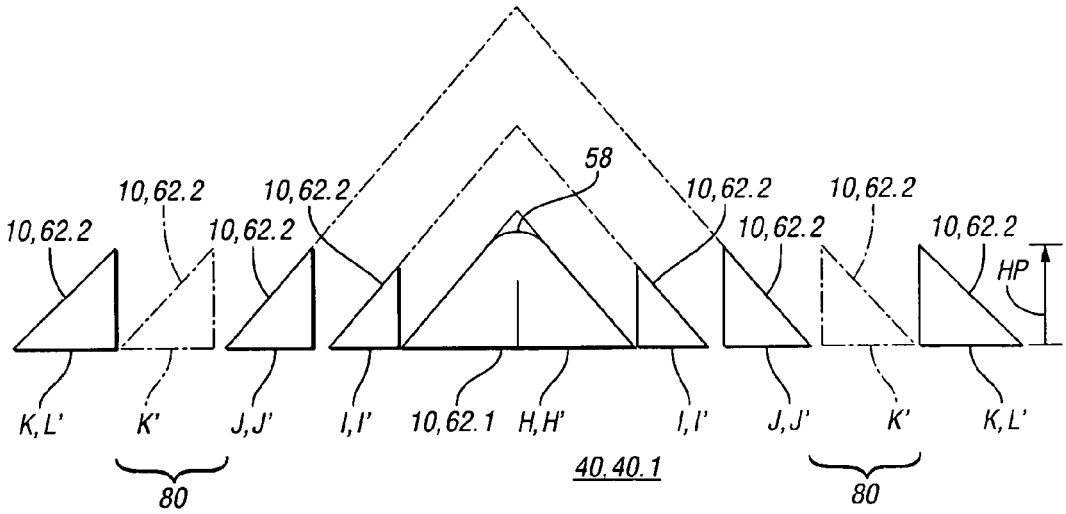

Referring to FIGS. 19*a* and 19*b*, as the allowable height Hp of the associated acoustic scatterer panel 12 is reduced, gaps 80 develop between the resulting partial fractals 62.2, J, K that may be filled with one or more intermediate partial fractals 62.2. For example, in the embodiment illustrated in FIGS. 19*a* and 19*b*, the largest full fractal 62.2 from the table of FIG. 7 for a wall-type embodiment of an acoustic scatterer panel 12 is fractal H, which is embodied in FIGS. 19*a* and 19*b* by fractal H'. The acoustic scatterer panel 12 is populated with partial fractals 62.2, I', J', K' and L', wherein partial fractals 62.2, I', J' and L' correspond to fractals I, J and K from the table of FIG. 7, and partial fractal 62.2, K' is intermediate to fractals J and K from the table of FIG. 7.

Figure 20A:
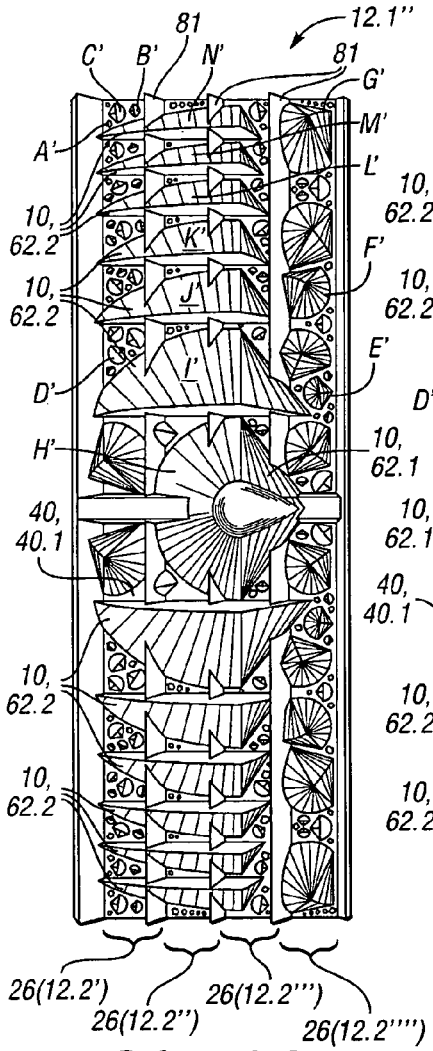
FIGS. 20*a-c* illustrate a plan view image, plan view outline and side view of a third embodiment of the first aspect of the acoustic scatterer panel.
Figure 20B:
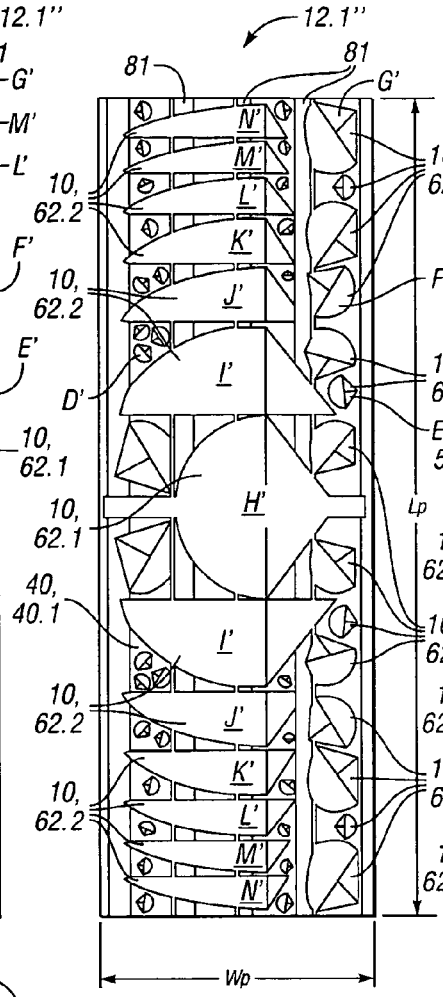
Figure 20C:
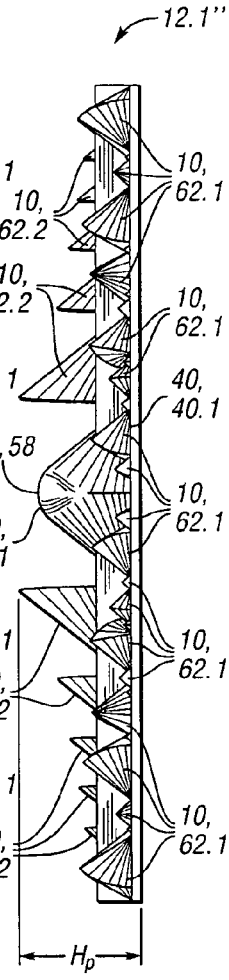

Referring to FIGS. 20*a-c*, a third embodiment of the first aspect of the acoustic scatterer panel 12.1" is illustrated which has a maximum height $H_P$ of 9 inches, which was adapted for installation in or on walls 28 or ceilings 16. The third embodiment of the first aspect of the acoustic scatterer panel 12.1" incorporates a plurality of intermediate longitudinal ribs 81 which provide stiffening. The third embodiment of the first aspect of the acoustic scatterer panel 12.1" provides provide for effective scattering and diffusion of acoustic energy in the high, middle and low frequency ranges, for frequencies down to 70 Hertz, and which provides for attenuating acoustic peaks so as to create a more even, comfortable listening environment.

Figure 21A:
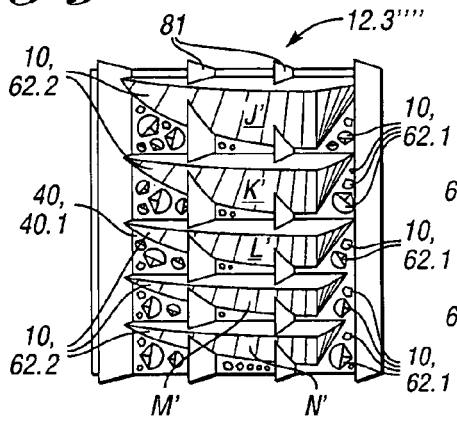
FIGS. 21*a-b* illustrates a plan view image and plan view outline of a lateral section of a fourth embodiment of a sectionalized acoustic scatterer panel in accordance with the third aspect.
Figure 21B:
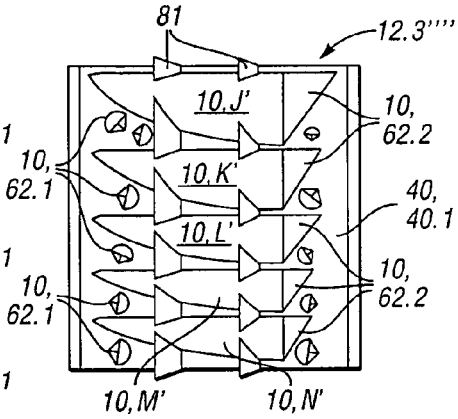
Figure 22A:
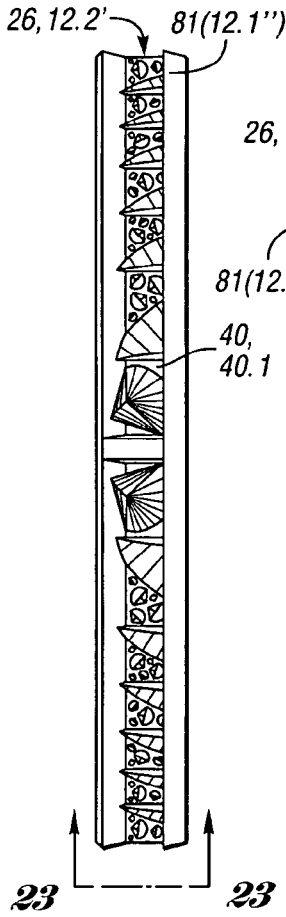
FIGS. 22*a-d* illustrates plan view images of various longitudinal sections of a sectionalized acoustic scatterer panel in accordance with a second aspect.
Figure 22B:
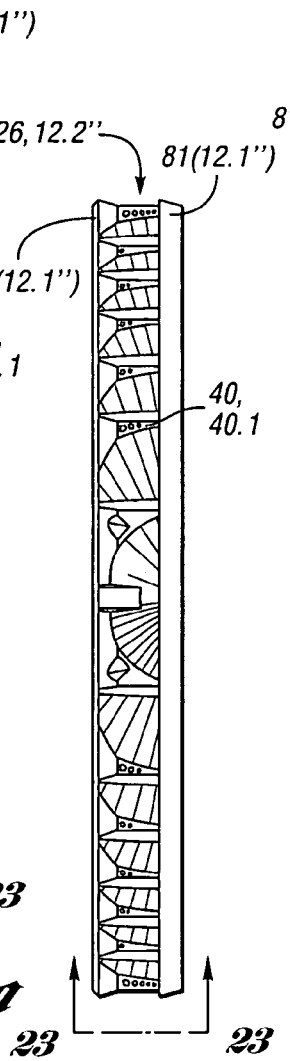
Figure 22C:
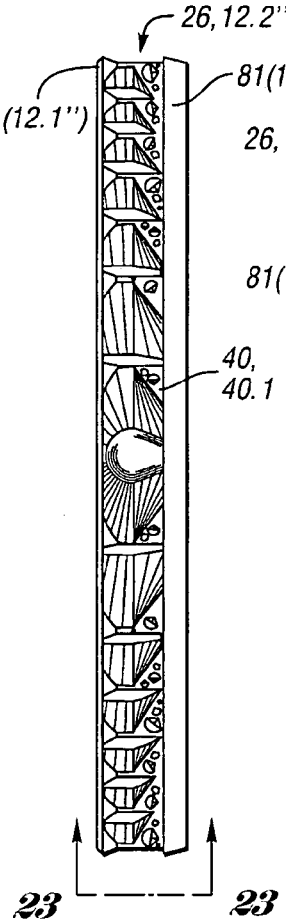
Figure 22D:
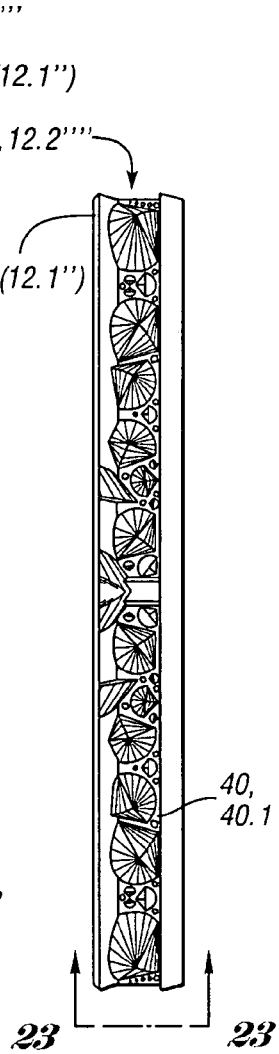

Referring to FIGS. 21*a-b*, the third embodiment of the first aspect of the acoustic scatterer panel 12.1" can be transversely sectionalized. For example, FIGS. 21*a-b* illustrate a transversely sectionalized portion 31 of a fourth embodiment of a sectionalized acoustic scatterer panel 12.3"" in accordance with the third aspect, which provides for equalization of middle to high frequencies found in most modern office environments, which can be readily installed in existing grid systems, or mounted directly to a wall 28, and which can be adapted to effectively diffuse sound from multiple sources and directions.

Figure 23:
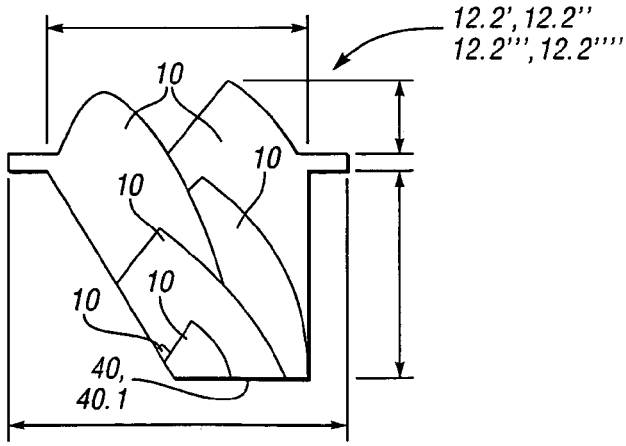
FIG. 23 illustrates an end view profile of a composite of the sectionalized acoustic scatterer panels illustrated in FIGS. 22*a-d;*

Referring to FIGS. 22*a-d*, the third embodiment of the first aspect of the acoustic scatterer panel 12.1" can be longitudinally sectionalized, for example, along the intermediate longitudinal ribs 81 thereof, so as to provide for resulting longitudinally sectionalized portions 26 in accordance with the second aspect of a scatterer panel 12.2', 12.2", 12.2'", 12.2"", respectively, a composite end view of which is illustrated in FIG. 23. The longitudinally sectionalized portions 26 can be recessed within portions of the walls 28 of a room 14, for example, in pockets between adjacent studs, wherein the longitudinally sectionalized portions 26 incorporate flanges 82 for attachment thereto. For example, in one embodiment, the longitudinally sectionalized portions 26 are adapted to be installed between 2"×8" wall studs, set on 9.5 inch centers. For example, in one embodiment, the recessed design reduces projection of the scatterer panel 12.2', 12.2", 12.2'", 12.2"" to 2.5 inches beyond the surface plane of the wall 28. The scatterer panels 12.2', 12.2", 12.2'", 12.2"" can be covered by a stretch fabric to complement any desired decorum.

Figure 24:
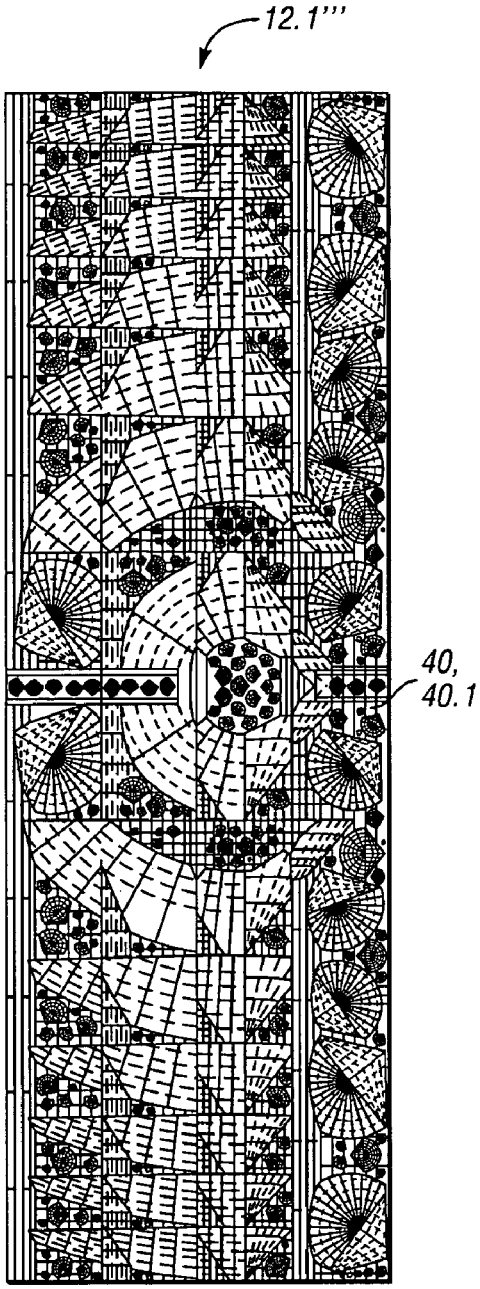
FIG. 24 illustrates a wireframe plan view of a fourth embodiment of the first aspect of the acoustic scatterer panel.
Figure 25:
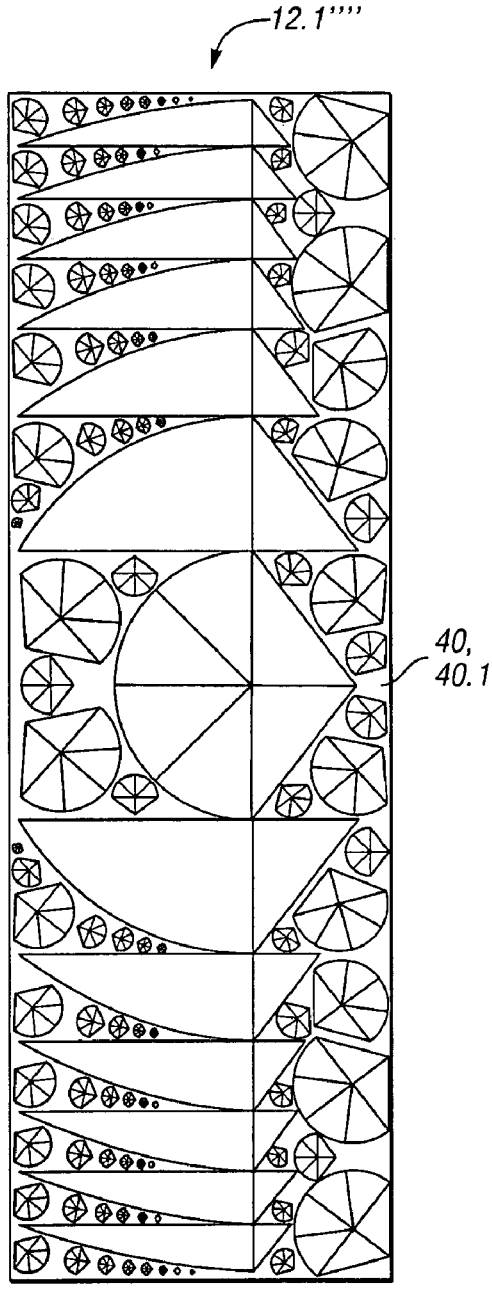
FIG. 25 illustrates a wireframe plan view of a fifth embodiment of the first aspect of the acoustic scatterer panel.

FIG. 24 and FIG. 25 illustrate a wireframe plan view of alternative fourth 12.1'" and fifth 12.1"" embodiments of the first aspect of the acoustic scatterer panel.

Figures 26, 27:
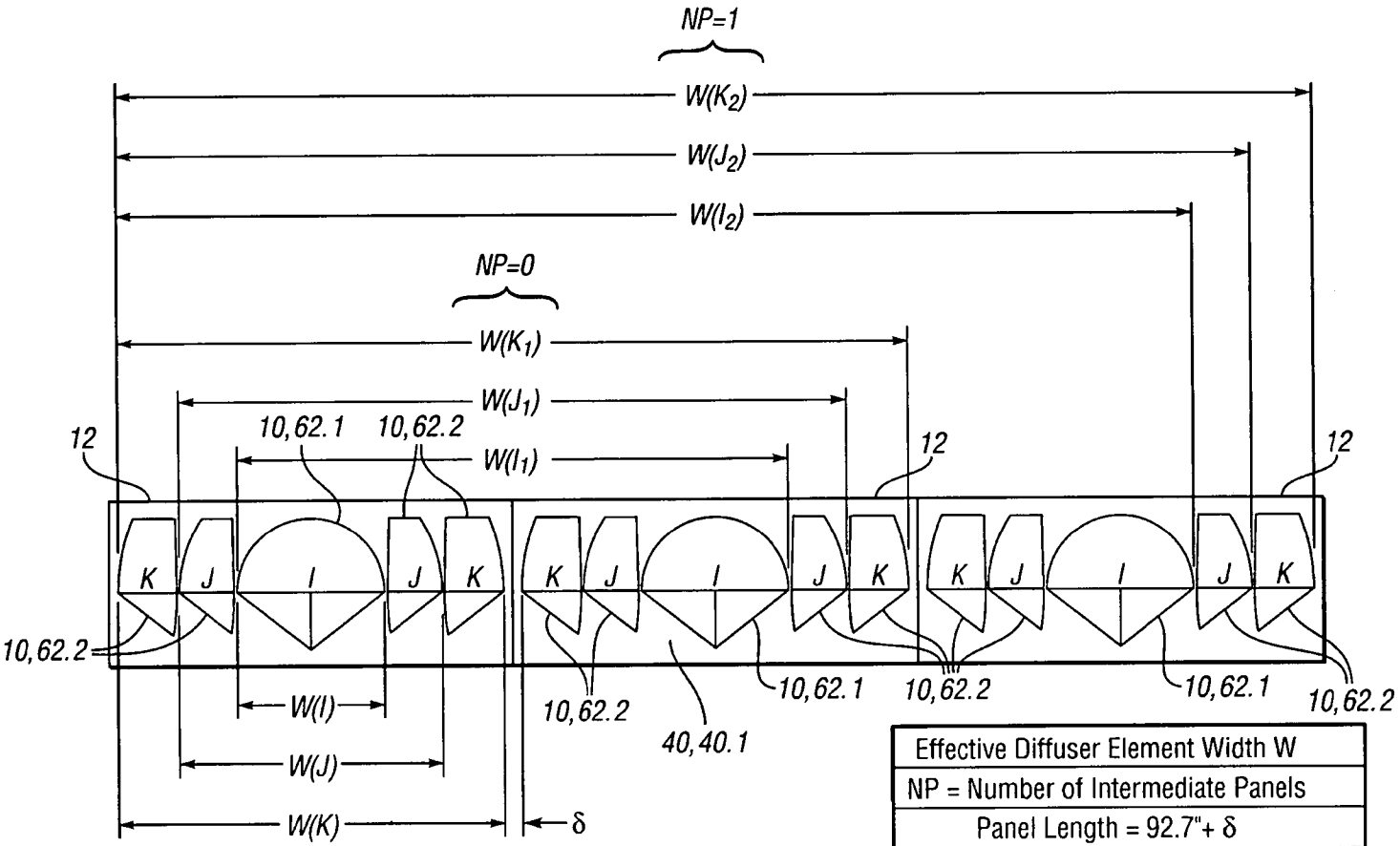
FIG. 26 illustrates a cooperation of different acoustic scatterer panels.
FIG. 27 illustrates a table of effective widths of various acoustic scatterer elements from different acoustic scatterer panels in cooperation with one another as illustrated in FIG. 26.
Figure 28A:
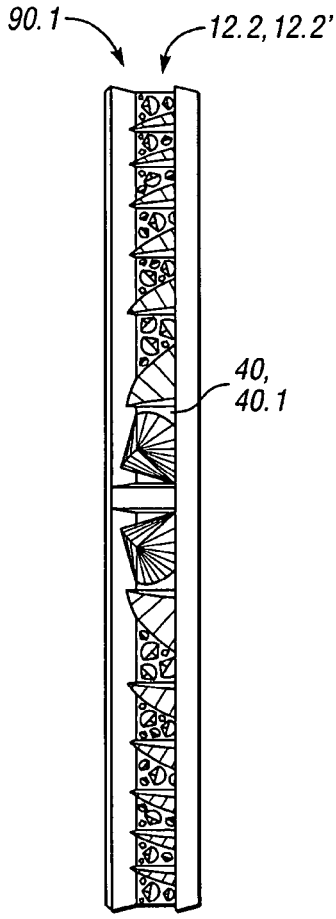
FIGS. 28*a-c* illustrates plan view images of various elements of an acoustic tuning element.
Figure 28B:
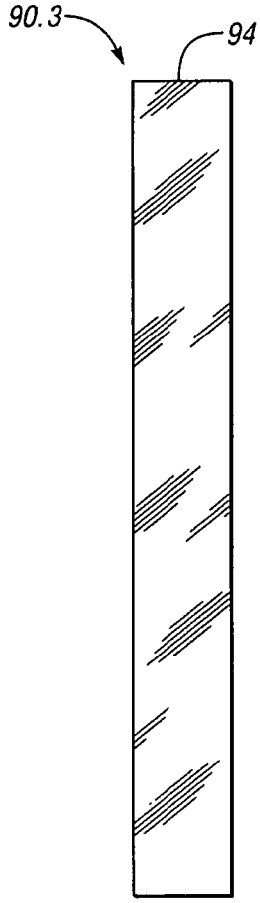
Figure 28C:
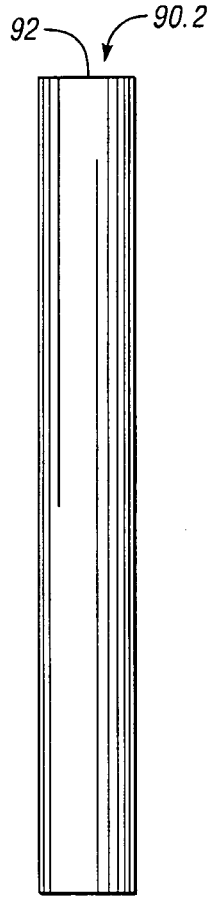

Referring to FIGS. 26 and 27 different acoustic scatterer panels 12 may be adapted to cooperate with one another so as to provide for lowering the lowest scattering or diffusion frequency. The table of FIG. 27 lists the effective width W of associated partial fractals 62.2 which result from the cooperation of different portions of acoustic scatterer elements 10 from different acoustic scatterer panels 12, in accordance with the arrangements illustrated in FIG. 26. Accordingly, a compromise in the diffusing/scattering capabilities of a particular acoustic scatterer panel 12 resulting from its finite size can be compensated and corrected by ganging the panels together when installing them to make up the desired sizing for the frequency range needed. It is also by this ganging that the panels are able to diffuse all the way to a 20 Hz wave, which has a ½ wave length of 25 feet, wherein the above data is based on the assumption of requiring a full ½ wave for effective diffusion although it is believed that the ¼ wave may be all that is needed to diffuse an acoustic wave, which would considerably extend the lower range of frequencies lower in frequency.

Figure 29:
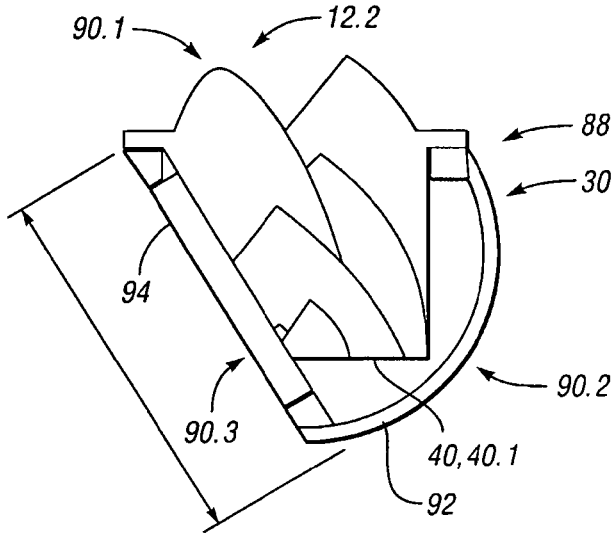
FIG. 29 illustrates an end view profile of an acoustic tuning element.
Figure 30A:
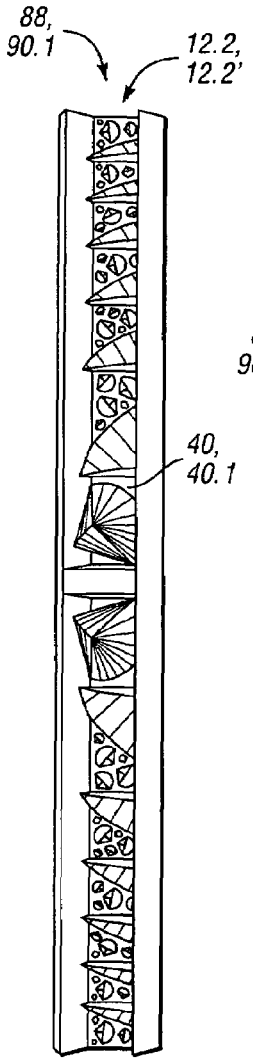
FIG. 30 illustrates plan view images of various acoustic scatterer elements that can be used in the acoustic tuning element associated with FIGS. 28*a-c* and FIG. 29.
Figure 30B:
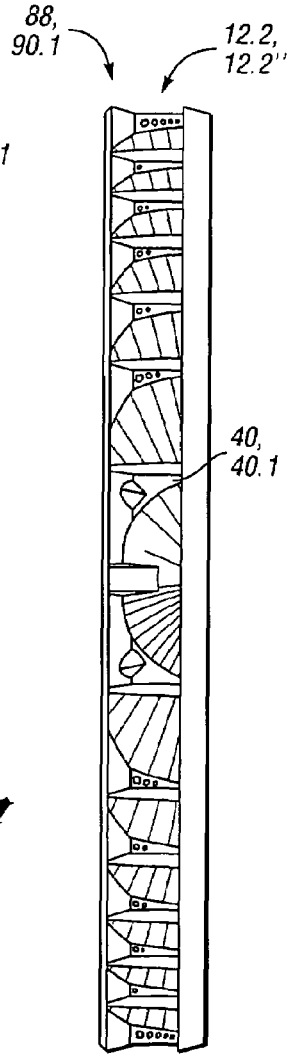
Figure 30C:
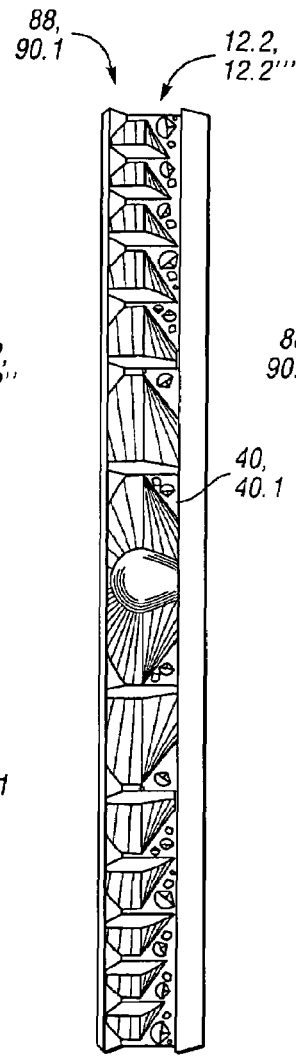
Figure 30D:
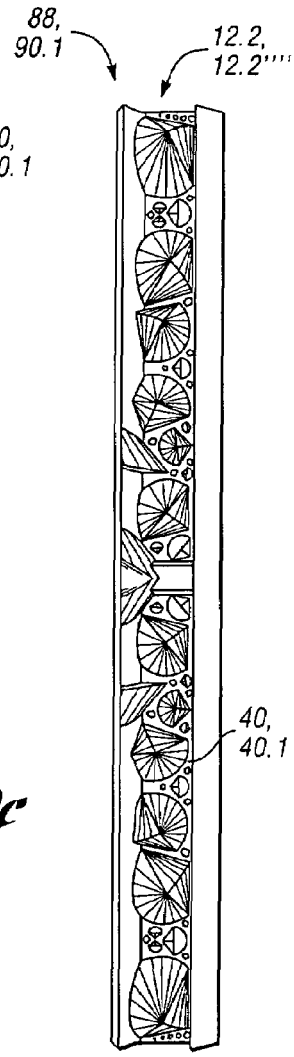

Referring to FIGS. 1, 28*a-c*, 29, and 30 various acoustic scatterer elements in accordance with the second aspect of a scatterer panel 12.2', 12.2", 12.2'", 12.2"" may be utilized in combination with reflective 84 or absorptive 86 panels of a three-sided prismatic tuning column 88 of a rotatable acoustic tuning unit 30 to provide for tuning the acoustics of a room 14. The embodiment of FIG. 29 illustrates a combination of a scatterer panel 12.2 in accordance with the second aspect on a first face 90.1 of the prismatic tuning column 88, in combination with a curved reflective surface 92 on a second face 90.2 of the prismatic tuning column 88, in combination with an absorptive material 94 on the third face 90.3 of the prismatic tuning column 88. The prismatic tuning column 88 provides for variable tuning by rotation thereof about a center post 96. The various surfaces can be rotated (positioned) to either; absorb sound, reflect it or diffuse it into the room. Four different prismatic tuning columns 88 make up one full array. These adjustable prismatic tuning column 88 are typically positioned on two adjacent walls and should cover most of the wall surfaces. In one embodiment, the prismatic tuning columns 88, which are about 8 feet long, are placed approximately 12 inches apart.

While specific embodiments have been described in detail, those with ordinary skill in the art will appreciate that various modifications and alternatives to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

The invention claimed is:

1. An acoustic scatterer, comprising:

a. at least one acoustic scatterer element, wherein said at least one acoustic scatterer element comprises:

i. at least one first curved surface, wherein at least a portion of said at least one first curved surface is curved about a first axis; and ii. at least one second curved surface, wherein at least a portion of said at least one second curved surface is curved about a second axis, said at least one second surface is continuous with said at least one first surface across a boundary therebetween, said at least one first curved surface is asymmetric with respect to said at least one second curved surface relative to said boundary between said at least one first curved surface and said at least one second curved surface, said acoustic scatterer element is adapted to be located on at least one reference surface, at least a portion of said at least one reference surface comprises or is proximate to a boundary of a region of an acoustic space, said first and second axes are in different directions, and at least one of said first and second axes is either oblique or orthogonal to said at least one reference surface.

2. An acoustic scatterer as recited in claim 1, wherein said at least one first surface comprises a portion of a first surface of revolution about said first axis, and said at least one second surface comprises a portion of a second surface of revolution about said second axis.

3. An acoustic scatterer as recited in claim 1, wherein said at least one first surface comprises a portion of a first swept surface about said first axis, and said at least one second surface comprises a portion of a second swept surface about said second axis.

4. An acoustic scatterer as recited in claim 1, wherein said at least one first surface is convex relative to said acoustic space, and said at least one second surface is convex relative to said acoustic space.

5. An acoustic scatterer as recited in claim 1, wherein said at least one first curved surface comprises at least one portion of a first conical surface, and said at least one second curved surface comprises at least a portion of at least a second conical surface.

6. An acoustic scatterer as recited in claim 1, wherein said first and second axes are substantially orthogonal to one another.

7. An acoustic scatterer as recited in claim 6, wherein said first axis is substantially orthogonal to said at least one reference surface, and said second axis is substantially parallel to said at least one reference surface.

8. An acoustic scatterer as recited in claim 7, wherein said at least one portion of said first conical surface is bounded by a first base portion at said at least one reference surface, said first base portion is distal to a corresponding first apex of said at least one portion of said first conical surface, said at least one second curved surface comprises portions of second and third conical surfaces, said second conical surface is bounded by a second base portion, said second base portion is distal to a corresponding second apex of said second conical surface, said portion of said third conical surface is bounded by a third base portion, said third base portion is distal to a corresponding third apex of said portion of said third conical surface, said portions of said second and third conical surfaces abut said first base portion of said at least one portion of said first conical surface, and said second and third apexes of said portions of said second and third conical surfaces abut said first base portion of said at least one portion of said first conical surface proximate to said at least one reference surface, and said second and third base portions are relatively more proximal than are said second and third apexes.

9. An acoustic scatterer as recited in claim 8, wherein said second and third base portions abut one another proximate to said first apex of said portion of said first conical surface, and said at least one portion of said first conical surface comprises a continuous first portion.

10. An acoustic scatterer as recited in claim 9, wherein a top of said at least one acoustic scatterer element is rounded so as to reduce a height thereof above said at least one reference surface, wherein said top is relatively distal with respect to said at least on reference surface.

11. An acoustic scatterer as recited in claim 8, wherein said at least one portion of said first conical surface comprises first and second portions of said first conical surface, said second and third base portions face one another, said first portion of said first conical surface is bounded by a fourth surface, said fourth surface is an extension of said second base portion, said second portion of said first conical surface is bounded by a fifth surface, said fifth surface is an extension of said third base portion, said portion of said second conical surface abuts said first base portion of said first portion of said first conical surface, and said portion of said third conical surface abuts said first base portion of said second portion of said first conical surface.

12. An acoustic scatterer as recited in claim 11, wherein said acoustic scatterer comprises at least one other acoustic scatterer element located on said at least one reference surface between said fourth and fifth surfaces.

13. An acoustic scatterer as recited in claim 1, wherein said at least one first curved surface is bounded by a sixth surface substantially parallel to said second axis.

14. An acoustic scatterer as recited in claim 1, wherein said at least one first curved surface has a first shape, said at least one second curved surface has a second shape, and said first and second shapes are different from one another.

15. An acoustic scatterer as recited in claim 14, wherein said at least one first curved surface is at least partially conical, and said at least one second curved surface is at least partially ellipsoidal.

16. An acoustic scatterer as recited in claim 1, further comprising a smoothing transition surface between at least a portion of said at least one first curved surface and said at least one second curved surface.

17. An acoustic scatterer as recited in claim 5, wherein said at least one portion of said first conical surface comprises a first portion of said first conical surface, said first portion of said first conical surface is partially bounded by a first base portion at said at least one reference surface, said first base portion is distal to a corresponding first apex of said first portion of said first conical surface, said first portion of said first conical surface is also partially bounded by a third surface so that said first portion of said first conical surface is distal to said first axis, said second conical surface is partially bounded by said third surface, said third surface is distal to a corresponding second apex of said second conical surface, said portion of said second conical surface abuts and is continuous with said first portion of said first conical surface.

18. An acoustic scatterer as recited in claim 17, wherein said first portion of said first conical surface is further bounded by a fourth surface, said fourth surface intersects said third surface, and said fourth surface is distal to said portion of said second conical surface.

19. An acoustic scatterer as recited in claim 1, wherein said at least one portion of said at least one first curved surface extends across a width where said at least one first curved surface abuts said at least one second curved surface along said at least one reference surface, a junction between said at least one first curved surface and said at least one second curved surface extends a height above said at least one reference surface, said a least one second curved surface extends a nose depth along said at least one reference surface from a line through a junction with said at least one first curved surface, said width is greater than said height, and said height is greater than said nose depth.

20. An acoustic scatterer as recited in claim 19, wherein a first ratio of said width to said height is at least approximately equal to the golden ratio, and a second ratio of said height to said nose depth is at least approximately equal to the golden ratio.

21. An acoustic scatterer as recited in claim 19, wherein said at least one acoustic scatterer element comprises a plurality of acoustic scatterer elements in cooperation with one another, and said height of at least one acoustic scatterer element is substantially equal to said width of another acoustic scatterer element.

22. An acoustic scatterer as recited in claim 19, wherein said at least one acoustic scatterer element comprises a plurality of acoustic scatterer elements in cooperation with one another, and said nose depth of at least one acoustic scatterer element is substantially equal to said height of another acoustic scatterer element.

23. An acoustic scatterer as recited in claim 19, wherein said at least one acoustic scatterer element comprises a plurality of acoustic scatterer elements in cooperation with one another, said height of at least one first acoustic scatterer element is substantially equal to said width of at least one second acoustic scatterer element, and said nose depth of said at least one first acoustic scatterer element is substantially equal to said height of said at least one second acoustic scatterer element.

24. An acoustic scatterer as recited in claim 20, wherein said at least one acoustic scatterer element comprises a plurality of acoustic scatterer elements in cooperation with one another, said height of at least one first acoustic scatterer element is substantially equal to said width of at least one second acoustic scatterer element, and said nose depth of said at least one first acoustic scatterer element is substantially equal to said height of said at least one second acoustic scatterer element.

25. An acoustic scatterer as recited in claim 1, wherein said at least one acoustic scatterer element comprises a plurality of acoustic scatterer elements in cooperation with one another.

26. An acoustic scatterer as recited in claim 25, wherein at least two of said plurality of acoustic scatterer elements in cooperation with one another are of different corresponding sizes.

27. An acoustic scatterer as recited in claim 26, wherein a ratio of a size of at least one acoustic scatterer element to a corresponding size of at least one other acoustic scatterer element is at least approximately an integral power of the golden mean.

28. An acoustic scatterer as recited in claim 26, wherein said at least two of said plurality of acoustic scatterer elements in cooperation with one another that are of said different sizes are located proximally adjacent to one another.

29. An acoustic scatterer as recited in claim 25, wherein at least two of said plurality of acoustic scatterer elements in cooperation with one another are similarly shaped.

30. An acoustic scatterer as recited in claim 25, wherein at least two of said plurality of acoustic scatterer elements in cooperation with one another are oriented in different directions.

31. An acoustic scatterer as recited in claim 30, wherein a first portion of at least one first said acoustic scatterer element is oriented towards a corresponding different second portion of at least one second said acoustic scatterer element, and said at least one first and at least one second acoustic scatterer elements are proximally adjacent to one another.

32. An acoustic scatterer as recited in claim 25, wherein said plurality of acoustic scatterer elements in cooperation with one another are arranged in a fractal pattern that is substantially independent of scale.

33. An acoustic scatterer as recited in claim 25, wherein at least one relatively smaller said acoustic scatterer element depends from a surface of at least one relatively larger said acoustic scatterer element.

34. An acoustic scatterer as recited in claim 33, wherein said at least one relatively larger said acoustic scatterer element incorporates said at least one reference surface from which said relatively smaller at least one acoustic scatterer element depends.

35. An acoustic scatterer as recited in claim 34, wherein said at least one reference surface from which said relatively smaller at least one acoustic scatterer element depends comprises a substantially planar surface on top of said at least one relatively larger said acoustic scatterer element.

36. An acoustic scatterer as recited in claim 35, wherein said at least one relatively smaller acoustic scatterer element comprises a plurality of relatively smaller acoustic scatterer elements that are of different sizes and different orientations.

37. An acoustic scatterer, comprising:

a. a plurality of acoustic scatterer elements, wherein each acoustic scatterer element of said plurality of acoustic scatterer elements is selected from a full acoustic scatterer element and a partial acoustic scatterer element;

b. wherein said full acoustic scatterer element comprises:

i. at least one first curved surface, wherein at least a portion of said at least one first curved surface is curved about a first axis; and ii. at least one second curved surface, wherein at least a portion of said at least one second curved surface is curved about a second axis, said at least one second surface is continuous with said at least one first surface across a boundary therebetween, said at least one first curved surface is asymmetric with respect to said at least one second curved surface relative to said boundary between said at least one first curved surface and said at least one second curved surface, said acoustic scatterer element is adapted to be located on at least one reference surface, at least a portion of said at least one reference surface comprises or is proximate to a boundary of a region of an acoustic space, said first and second axes are in different directions, at least one of said first and second axes is either oblique or orthogonal to said at least one reference surface, said full acoustic scatterer element is bounded by said at least one reference surface, and said at least one first curved surface and said at least one second curved surface of said full acoustic scatterer are otherwise continuous with one another; and c. said partial acoustic scatterer element comprises a portion of an associated virtual full acoustic scatterer element, wherein said portion is partially bounded by at least a third surface that would otherwise cut through said associated virtual acoustic scatterer element.

38. An acoustic scatterer as recited in claim 37, wherein said at least a third surface comprises a third surface substantially parallel to said second axis, and said third surface at least partially bounds said at least one first curved surface.

39. An acoustic scatterer as recited in claim 38, wherein said first axis intersects said partial acoustic scatterer element.

40. An acoustic scatterer as recited in claim 37, wherein said at least a third surface comprises a third surface substantially transverse to said second axis, said third surface at least partially bounds said at least one first curved surface and said at least one second curved surface, and said partial acoustic scatterer element is displaced from said first axis.

41. An acoustic scatterer as recited in claim 37, wherein said at least a third surface comprises a third surface and a fourth surface, said third surface is substantially transverse to said second axis, said third surface at least partially bounds said at least one first curved surface and said at least one second curved surface, said partial acoustic scatterer element is displaced from said first axis, said fourth surface is substantially parallel to said second axis, and said fourth surface at least partially bounds said at least one first curved surface.

42. An acoustic scatterer as recited in claim 37, wherein said plurality of acoustic scatterer elements are similarly shaped.

43. An acoustic scatterer as recited in claim 37, wherein at least two of said plurality of acoustic scatterer elements have corresponding different sizes.

44. An acoustic scatterer as recited in claim 42, wherein said plurality of acoustic scatterer elements comprise a full acoustic scatterer element and at least one partial acoustic scatterer element, and said associated virtual full acoustic scatterer element of said at least one partial acoustic scatterer element is larger than said full acoustic scatterer element by a factor.

45. An acoustic scatterer as recited in claim 44, wherein said factor is approximately a power of the golden mean.

46. An acoustic scatterer as recited in claim 44, wherein said first axes of at least two of said plurality of acoustic scatterer elements are substantially collinear.

47. An acoustic scatterer as recited in claim 44, wherein said second axes of at least two of said plurality of acoustic scatterer elements are substantially collinear.

48. An acoustic scatterer as recited in claim 44, wherein said associated virtual full acoustic scatterer element of at least one partial acoustic scatterer element is larger than another acoustic scatterer element by a factor of approximately the golden mean, further comprising another partial acoustic scatterer element located between said at least one partial acoustic scatterer element and said another acoustic scatterer element, wherein a size of said associated virtual full acoustic scatterer element of said another partial acoustic scatterer element is intermediate to a size of said at least one partial acoustic scatterer element and said another acoustic scatterer element, and said third surfaces of said at least one partial acoustic scatterer element and said another partial acoustic scatterer element are oriented in substantially the same direction.

49. An acoustic scatterer as recited in claim 44, wherein said at least one partial acoustic scatterer element comprises at least one pair of similarly sized and shaped partial acoustic scatterer elements, said pair of similarly sized and shaped partial acoustic scatterer elements are oriented so that said third surfaces thereof face one another with said full acoustic scatterer element located therebetween.

50. An acoustic scatterer as recited in claim 37, wherein said at least one reference surface comprises at least one wall or ceiling of a room in a building, and said plurality of acoustic scatterer elements are attached to said at least one wall or ceiling.

51. An acoustic scatterer as recited in claim 50, wherein at least one of said plurality of acoustic scatterer elements is individually formed and is attached to said at least one wall or ceiling by either bonding, fastening, or vacuum, electrostatic or magnetic attachment.

52. An acoustic scatterer as recited in claim 50, wherein at least one of said plurality of acoustic scatterer elements is formed as a part of said at least one wall or ceiling.

53. An acoustic scatterer as recited in claim 37, wherein said at least one reference surface is defined by a corresponding surface of at least one panel, and said plurality of acoustic scatterer elements are either attached to or an integral part of said at least one panel.

54. An acoustic scatterer as recited in claim 53, wherein said at least one panel is adapted to attach to a surface of a wall or ceiling of a room in a building.

55. An acoustic scatterer as recited in claim 54, wherein said at least one panel is adapted to be mounted in a ceiling grid of said room.

56. An acoustic scatterer as recited in claim 53, wherein said at least one panel is adapted to be mounted in a pocket between wall studs of said room in said building, wherein when mounted in said pocket between said wall studs of said room in said building, said plurality of acoustic scatterer elements are exposed to said acoustic space of said room.

57. An acoustic scatterer as recited in claim 53, wherein said at least one panel comprises at least one flange oriented obliquely to said at least one reference surface, wherein said at least one flange provides for mounting said at least one panel to a corner of a room.

58. An acoustic scatterer as recited in claim 57, wherein said corner of said room is located between adjacent walls of said room.

59. An acoustic scatterer as recited in claim 57, wherein said corner of said room is located between a wall and a ceiling of said room.

60. An acoustic scatterer as recited in claim 53, wherein said at least one panel comprises at least one rib so as to provide for stiffening said at least one panel.

61. An acoustic scatterer as recited in claim 60, wherein said at least one rib extends across a plurality of said acoustic scatterer elements on said at least one panel.

62. An acoustic scatterer as recited in claim 61, wherein each said second axis of a plurality of said plurality of acoustic scatterer elements is substantially parallel or collinear with respect to one another, and said at least one rib is substantially parallel to at least one said second axis.

63. An acoustic scatterer as recited in claim 37, wherein said plurality of acoustic scatterer elements comprise a plurality of pluralities of said acoustic scatterer elements, each plurality of pluralities of said acoustic scatterer elements is associated with a corresponding reference surface, each said corresponding reference surface is defined by a surface of a separate panel, for each said separate panel said plurality of acoustic scatterer elements associated with said panel are either attached to or an integral part of said panel, said separate panels are mounted on or a part of corresponding separate prismatic faces of an acoustic chandelier, and said acoustic chandelier is adapted to be suspended from a ceiling of a room of a building.

64. An acoustic scatterer as recited in claim 63, wherein each said prismatic face of said acoustic chandelier incorporates a separate said panel.

65. An acoustic scatterer as recited in claim 63, wherein said acoustic chandelier incorporates at least one acoustic grill between at least two of said separate panels.

66. An acoustic scatterer as recited in claim 63, wherein said acoustic chandelier incorporates an acoustic absorptive material therewithin in a space bounded by said separate panels.

67. An acoustic scatterer, comprising:

a. at least one portion of an acoustic scatterer panel, wherein said acoustic scatterer panel comprises:

i. a plurality of acoustic scatterer elements, wherein each acoustic scatterer element of said plurality of acoustic scatterer elements is selected from a full acoustic scatterer element and a partial acoustic scatterer element, at least two of said plurality of acoustic scatterer elements have corresponding different sizes, and said at least one portion of said acoustic scatterer panel spans at least two of said plurality of acoustic scatterer elements having corresponding different sizes;

ii. wherein said full acoustic scatterer element comprises:

a) at least one first curved surface, wherein at least a portion of said at least one first curved surface is curved about a first axis; and b) at least one second curved surface, wherein at least a portion of said at least one second curved surface is curved about a second axis, said at least one second surface is continuous with said at least one first surface across a boundary therebetween, said at least one first curved surface is asymmetric with respect to said at least one second curved surface relative to said boundary between said at least one first curved surface and said at least one second curved surface, said acoustic scatterer element is adapted to be located on at least one reference surface, at least a portion of said at least one reference surface comprises or is proximate to a boundary of a region of an acoustic space, said first and second axes are in different directions, at least one of said first and second axes is either oblique or orthogonal to said at least one reference surface, said full acoustic scatterer element is bounded by said at least one reference surface, and said at least one first curved surface and said at least one second curved surface of said full acoustic scatterer are otherwise continuous with one another, and iii. said partial acoustic scatterer element comprises a portion of an associated virtual full acoustic scatterer element, wherein said portion is partially bounded by at least a third surface that would otherwise cut through said associated virtual acoustic scatterer element.

68. An acoustic scatterer as recited in claim 67, wherein said at least one portion of said acoustic scatterer panel is oriented with at least one second axis of at least one acoustic scatterer element of said acoustic scatterer panel oriented substantially horizontally in said room so as to provide for acoustically tuning said room.

69. An acoustic scatterer as recited in claim 67, wherein said at least one portion of said acoustic scatterer panel is oriented with at least one second axis of at least one acoustic scatterer element of said acoustic scatterer panel oriented substantially vertically in said room so as to provide for acoustically tuning said room.

70. An acoustic scatterer as recited in claim 67, wherein said at least one portion of said acoustic scatterer panel comprises a plurality of different portions of said acoustic scatterer panel, said plurality of different portions of said acoustic scatterer panel are formed in separate acoustic scatterer panel portions, and said separate acoustic scatterer panel portions are located within a room of a building so as to provide for acoustically tuning said room.

71. An acoustic scatterer as recited in claim 67, wherein each said second axis of a plurality of said plurality of acoustic scatterer elements is substantially parallel or collinear with respect to one another, and a pair of longitudinal opposing boundaries of said at least one portion of said acoustic scatterer panel are substantially parallel to at least one said second axis.

72. An acoustic scatterer as recited in claim 67, wherein each said second axis of a plurality of said plurality of acoustic scatterer elements is substantially parallel or collinear with respect to one another, and a pair of transverse opposing boundaries of said at least one portion of said acoustic scatterer panel are substantially perpendicular to at least one said second axis.

73. An acoustic scatterer as recited in claim 71, wherein said at least one portion of said acoustic scatterer panel is incorporated in at least a first prismatic face of a corresponding at least one rotatable prismatic acoustic tuning column, and each said corresponding at least one rotatable prismatic acoustic tuning column is adapted to rotate about a corresponding axis.

74. An acoustic scatterer as recited in claim 73, wherein said at least one rotatable prismatic acoustic tuning column further comprises at least one acoustic absorptive panel on at least one second prismatic face of said least one rotatable prismatic acoustic tuning column.

75. An acoustic scatterer as recited in claim 73, wherein said at least one rotatable prismatic acoustic tuning column further comprises at least one curved acoustic reflective surface on at least one second prismatic face of said least one rotatable prismatic acoustic tuning column.

76. An acoustic scatterer as recited in claim 74, wherein said at least one rotatable prismatic acoustic tuning column further comprises at least one curved acoustic reflective surface on at least one third prismatic face of said least one rotatable prismatic acoustic tuning column.

77. An acoustic scatterer as recited in claim 71, wherein said at least one rotatable prismatic acoustic tuning column is located in a room of a building so as to provide for adjusting an acoustic tuning of said room by rotating said rotatable prismatic acoustic tuning column.

78. An acoustic scatterer as recited in claim 77, wherein said at least one rotatable prismatic acoustic tuning column comprises a plurality of rotatable prismatic acoustic tuning columns, wherein at least two of said plurality of rotatable prismatic acoustic tuning columns incorporate different said portions of said acoustic scatterer panel.

79. An acoustically treated room of a building, comprising:

a. a plurality of acoustic scatterer elements, wherein each acoustic scatterer element of said plurality of acoustic scatterer elements is selected from a full acoustic scatterer element and a partial acoustic scatterer element, at least two of said plurality of acoustic scatterer elements have corresponding different sizes;

b. wherein said full acoustic scatterer element comprises:

i. at least one first curved surface, wherein at least a portion of said at least one first curved surface is curved about a first axis; and ii. at least one second curved surface, wherein at least a portion of said at least one second curved surface is curved about a second axis, said at least one second surface is continuous with said at least one first surface across a boundary therebetween, said at least one first curved surface is asymmetric with respect to said at least one second curved surface relative to said boundary between said at least one first curved surface and said at least one second curved surface, said acoustic scatterer element is adapted to be located on at least one reference surface, at least a portion of said at least one reference surface comprises or is proximate to a boundary of a region of an acoustic space within said room, said first and second axes are in different directions, at least one of said first and second axes is either oblique or orthogonal to said at least one reference surface, said full acoustic scatterer element is bounded by said at least one reference surface, and said at least one first curved surface and said at least one second curved surface of said full acoustic scatterer are otherwise continuous with one another; and c. said partial acoustic scatterer element comprises a portion of an associated virtual full acoustic scatterer element, wherein said portion is partially bounded by at least a third surface that would otherwise cut through said associated virtual acoustic scatterer element.

80. An acoustically treated room of a building as recited in claim 79, wherein at least one said acoustic scatterer element is operatively associated with at least one boundary of said room or with at least one other room element.

81. An acoustically treated room of a building as recited in claim 79, wherein said at least one first surface is convex relative to said acoustic space, and said at least one second surface is convex relative to said acoustic space.

82. An acoustically treated room of a building as recited in claim 79, wherein said at least one first curved surface comprises at least one portion of a first conical surface, and said at least one second curved surface comprises at least a portion of at least a second conical surface.

83. An acoustically treated room of a building as recited in claim 79, wherein at least one said acoustic scatterer element is incorporated in or on an acoustic chandelier suspended within the boundaries of said room.

84. An acoustically treated room of a building as recited in claim 83, wherein said acoustic chandelier comprises a plurality of prismatic faces, and each of said plurality of prismatic faces incorporates at least one of said plurality of acoustic scatterer elements.

85. An acoustically treated room of a building as recited in claim 79, wherein said at least one reference surface is defined by a corresponding surface of at least one panel, and said plurality of acoustic scatterer elements are either attached to or an integral part of said at least one panel.

86. An acoustically treated room of a building as recited in claim 85, wherein said at least one panel comprises at least two said panels, and said at least two said panels extend obliquely downwards from a ceiling of said room.

87. An acoustically treated room of a building as recited in claim 85, wherein said at least one panel comprises a plurality of panels, and at least two said acoustic scatterer elements of separate panels of said plurality of panels cooperate with one another so as to at least partially emulate a relatively larger acoustic scatterer element.

88. An acoustically treated room of a building as recited in claim 87, wherein said at least one first curved surface and said at least one second curved surface of said acoustic scatterer elements in cooperation with one another are oriented as would be corresponding portions of said relatively larger acoustic scatterer element.

89. An acoustically treated room of a building as recited in claim 88, wherein said plurality of said panels are arranged so that said first axes of said at least one scatterer element are substantially co-planar, and said second axis of at least one acoustic scatterer element of separate said panels are substantially collinear.

90. An acoustically treated room of a building as recited in claim 87, wherein said acoustic scatterer elements in cooperation with one another comprise separate said full acoustic scatterer elements of separate said panels.

91. An acoustically treated room of a building as recited in claim 87, wherein said acoustic scatterer elements in cooperation with one another comprise separate said partial acoustic scatterer elements of separate said panels.

* * * * *

UNITED STATES PATENT AND TRADEMARK OFFICE

CERTIFICATE OF CORRECTION

PATENT NO. : 7,604,094 B2
APPLICATION NO. : 11/910260
DATED : October 20, 2009
INVENTOR(S) : Douglas P. Magyari It is certified that error appears in the above-identified patent and that said Letters Patent is hereby corrected as shown below:

On the Title page, in the "(*) Notice":
"0 days" should read --56 days--, so that the associated Notice of Patent Term Adjustment reads as follows: --Subject to any disclaimer, the term of this patent is extended or adjusted under 35 U.S.C. 154(b) by 56 days--.

On the Title page, in "(22) PCT No.:":
"PCT/JP2006/013992" should read --PCT/US2006/013992--.

On the Title page, in "(65) Prior Publication Data":
"US 2008/0308349 A1" should read --US 2008/0308349 A2--.

Signed and Sealed this

Twenty-sixth Day of January, 2010

David J. Kappos

David J. Kappos
*Director of the United States Patent and Trademark Office*